US007062216B2

(12) United States Patent
Nobe et al.

(10) Patent No.: US 7,062,216 B2
(45) Date of Patent: Jun. 13, 2006

(54) IMAGE FORMING DEVICE CAPABLE OF SELECTIVELY MOUNTING DIFFERENT SHEET FEED UNITS

(75) Inventors: Hiroshi Nobe, Nagoya (JP); Atsushi Hayakawa, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 130 days.

(21) Appl. No.: 10/699,790

(22) Filed: Nov. 4, 2003

(65) Prior Publication Data

US 2004/0091283 A1 May 13, 2004

(30) Foreign Application Priority Data

Nov. 5, 2002 (JP) ..... 2002-320839

(51) Int. Cl.
*G03G 15/00* (2006.01)

(52) U.S. Cl. ..... 399/391; 399/392

(58) Field of Classification Search ..... 399/111, 399/124, 391, 392, 393
See application file for complete search history.

(56) References Cited

U.S. PATENT DOCUMENTS 4,436,406 A * 3/1984 Murasaki et al. ..... 399/392
4,580,890 A * 4/1986 Sugizaki et al. ..... 399/391
4,860,055 A * 8/1989 Ohira et al. ..... 399/81
5,008,715 A * 4/1991 Imaizumi et al. ..... 399/392
5,056,768 A * 10/1991 Koyama ..... 271/3.19
5,150,166 A * 9/1992 Matsuura et al. ..... 399/110
6,678,490 B1 * 1/2004 Tanaka ..... 399/124

FOREIGN PATENT DOCUMENTS

JP A 62-230538 10/1987
JP A 8-95332 4/1996
JP 11194567 A * 7/1999
JP A 2001-219366 8/2001
JP A 2002-80132 3/2002

* cited by examiner

*Primary Examiner*—Robert Beatty
(74) *Attorney, Agent, or Firm*—Oliff & Berridge, PLC

(57) ABSTRACT

In an image forming device, left and right mounting frames are disposed on the respective left and right frames of the image forming device by hooking pawls provided on the front side thereof. The mounting frames support a paper supply roller and separating mechanism. A trigger unit is fixed inside the left frame for turning ON and OFF the driving of the paper supply roller via a gear. A multipurpose unit is swingably supported on the mounting frames by a support unit. However, when a manual feed unit is mounted in the image forming device, the left and right mounting frames and the trigger unit are not installed, but the manual feed unit is swingably supported on bearing protrusions.

23 Claims, 14 Drawing Sheets

1
100,110
2
3
45
18
46
21a
L
22
30
120
20
29
27
16
21b
19
31
33
57
200
23
24
17
34
36
35
36a
A
10
11
8
FRONT
14
14a
6
13
9
4
7b
130
47b
50c
7
85
80
95
7a
50b
90
81
50a
26
130
REAR
44
48
43
B
43
41
41a
42
47a
48a
44a
47a

IMAGE FORMING DEVICE CAPABLE OF SELECTIVELY MOUNTING DIFFERENT SHEET FEED UNITS

BACKGROUND OF THE INVENTION

1. Field of the Invention

The present invention relates to an image forming device having a frame in which differing paper supply units are selectively mounted.

2. Related Art

In conventional image forming devices, such as laser printers and copy machines, a photosensitive member is uniformly charged and subsequently exposed to the light of a laser, LED, or the like to form electrostatic latent images thereon. After being developed into a visible image by toner or another developer, the image is transferred onto a recording medium, such as paper, and is subsequently heated in a fixing unit to fix the image thereon. Usually, the recording medium is accommodated as a stack in a paper supply cassette, supplied into the image forming device, and conveyed inside the image forming device along a U-shaped or S-shaped path for printing. However, when printing on a recording medium that is difficult to bend or that cannot endure bending easily, such as thick paper, postcards, and transparencies, the recording medium is conveyed along a relatively straight path from the front side of the image forming device to the rear side.

In some cases, a paper supply device unit for smoothly supplying a recording medium into the image forming device is mounted in a frame prior to shipping. In this case, a plurality of frames must be produced for mounting differing paper supply units so that the user can select from a plurality of models to suit the user's budget. However, productivity drops when manufacturing a different frame for each paper supply unit. In order to overcome this problem, it has been proposed to attach mounting units matching differing paper supply units to a frame of the image forming device to enable the differing paper supply units to be mounted in the common frame.

For example, the invention disclosed in Japanese unexamined patent application publication No. SHO-62-230538 allows a manual feed type paper supply unit for supplying one sheet of recording medium at a time and a multi-type paper supply unit for accommodating a plurality of recording medium and automatically supplying the same to be selectively mounted in a common frame. The multi-type paper supply unit includes a clutch connected to a shaft of a paper supply roller, and the clutch switches ON and OFF of the transfer state of driving force to the paper supply roller.

However, providing the clutch to the multi-type paper supply unit requires a space in the multi-type paper supply unit for accommodating the clutch, which adversely increases the overall size of the image forming device. Further, the image forming device must be provided with a cover in order to provide access for replacing the photosensitive member and the developing device. Because the cover is provided separate from the paper supply units, the overall size of the image forming device is adversely increased.

SUMMARY OF THE INVENTION

In view of foregoing, it is an object of the present invention to overcome the above problems, and also to provide a compact image forming device that has a common frame in which differing paper supply units can be selectively mounted.

In order to attain the above and other objects, the present invention provides an image forming device including an image forming unit, a frame, and a fixing member. The image forming unit forms an image on a recording medium. The frame supports the image forming unit and also selectively supports a manual feed unit and a multipurpose unit. The manual feed unit has a guide unit that supports and guides a single sheet of recording medium to the image forming unit. The multipurpose unit has a supply unit that supports a stack of recording medium and supplies a single sheet of the stack of recording medium to the image forming unit. The frame has a first mounting unit to which the manual feed unit is attached and a second mounting unit to which the multipurpose unit is attached. The The fixing member is provided to the frame and capable of mounting a trigger unit that switches between an operating state and an idle state of the supply unit when the multipurpose unit is attached to the second mounting unit.

There is also provided an image forming device including an image forming unit and a frame. The image forming unit forms an image on a recording medium. The frame detachably supports the image forming unit and selectively supports a manual feed unit having a guide unit that supports and guides a single sheet of recording medium to the image forming unit and a multipurpose unit having a supply unit that supports a stack of recording medium and supplies a single sheet of the stack of recording medium to the image forming unit. The frame includes a first mounting unit and a second mounting unit. The frame is formed with an opening through which the image forming unit is mounted to and detached from the frame. The first mounting unit is capable of swingably mounting the manual feed unit that includes a cover that covers the opening of the frame and a guide unit that supports and guides a single sheet of recording medium to the image forming unit. The second mounting unit is capable of mounting the multipurpose unit that includes a cover that covers the opening of the frame and a supply unit that supports a stack of recording medium and supplies a single sheet of the stack of recording medium to the image forming unit.

PREFERRED EMBODIMENTS OF THE PRESENT INVENTION

A laser printer 1 according to an embodiment of the present invention will be described with reference to the accompanying drawings. First, overall structure of the laser printer 1 will be described with reference to FIG. 1.

Figure 1:
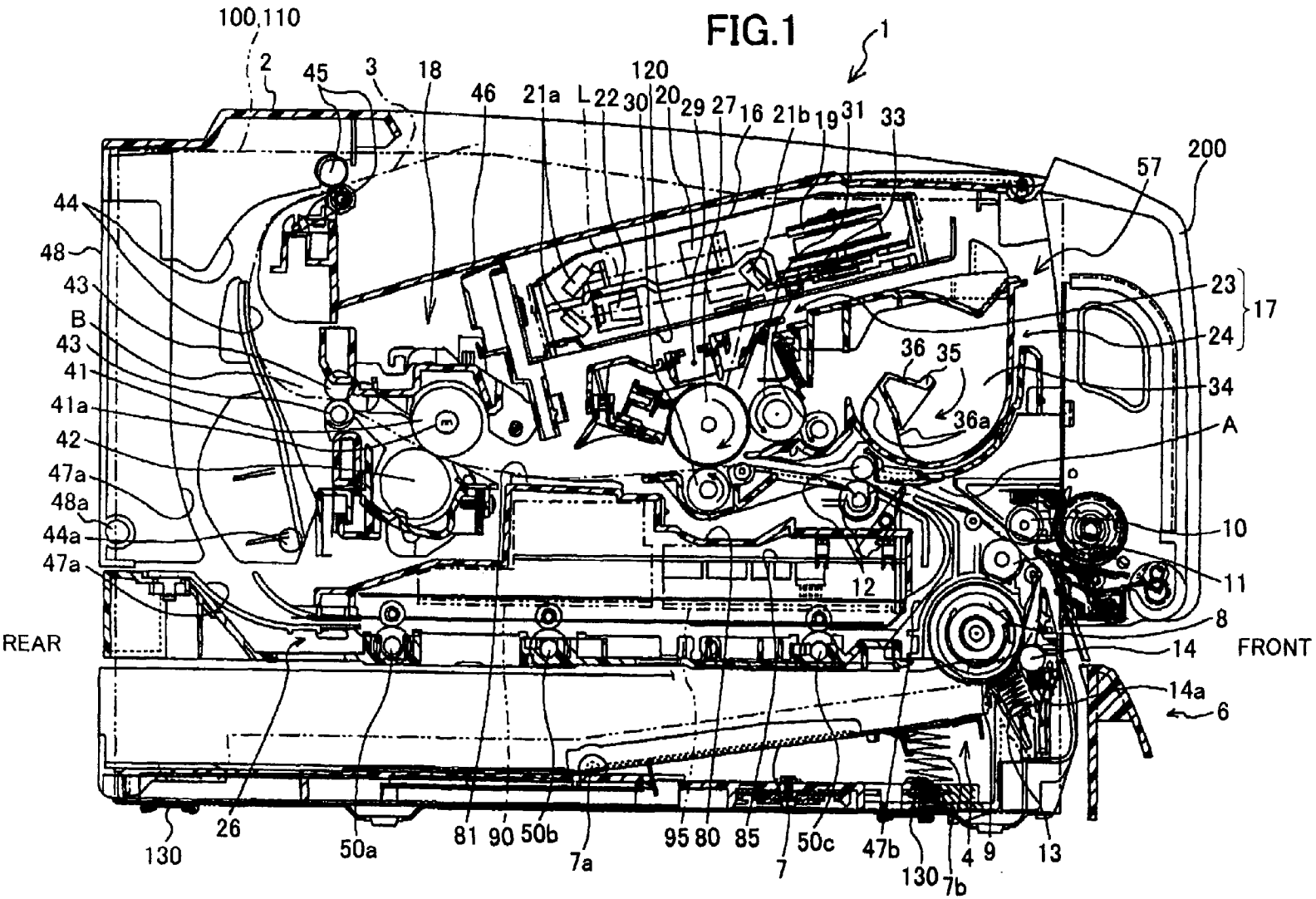
FIG. 1 is a cross-sectional view of a laser printer according to an embodiment of the present invention.

As shown in FIG. 1, the laser printer 1 includes a feeder section 4, an image forming section, and a duplex printing unit 26, all accommodated in a main casing 2. The feeder section 4 is for feeding a sheet 3. The image forming section is for forming a predetermined image on the fed sheet 3 and includes a scanner unit 16, a process cartridge 17, and a fixing unit 18.

The fixing unit 18 is disposed downstream from the process cartridge 17 with respect to a sheet feed direction of the sheet 3, on a rear end side in a lower part of the main casing 2.

A sheet discharge tray 46 is located at the upper center surface of the main case body 2, slanting upward to form a recessed shape. Printed sheets 3 are discharged from the main case body 2 into the stack on the sheet discharge tray 46.

A space having an open side is defined in the front upper section of the main casing 2. The processing cartridge 17 is mounted inside the space through a mounting hole 57 when the multipurpose unit 200 mounted on the front surface of the main casing 2 is widely open. A rear cover 48 is disposed on the rear surface of the main casing 2 so as to be capable of opening widely by pivoting downward about a support shaft 48*a*. A manual feed unit 300 (FIG. 9) could be mounted on the laser printer 1 as an alternative to the multipurpose unit 200. The multipurpose unit 200 and the manual feed unit 300 will be described in more detail later.

A sheet delivery path 44 is provided at the rear part in the main casing 2. The sheet delivery path 44 is formed in a semi-arc shape that extends vertically along the back of the main casing 2.

When the rear cover 48 is open, a lower part of the sheet delivery path 44 can pivot about a support shaft 44*a* to widely open so that the sheet delivery path 44 can discharge a paper 3 toward the rear of the laser printer 1 from conveying rollers 43 of the fixing unit 18.

The feeder section 4 will be described in detail. The feeder section 4 includes a sheet feed tray 6, a sheet feed roller 8, a sheet pressing plate 7, a separation pad 9, a paper powder removing roller 10, a conveying roller 11, registration rollers 12, and a paper dust roller 14. The sheet feed tray 6 is detachably mounted on the front side of the main casing 2. The sheet feed tray 6 is pulled forward to remove the sheet feed tray 6 from the main casing 2 and pushed rearward to mount onto the main casing 2.

The sheet feed roller 8 is provided in a bottom part of the main casing 2. The sheet pressing plate 7 is provided in the sheet feed tray 6, and the sheets 3 are stacked on the sheet pressing plate 7. The sheet pressing plate 7 is pivotable about a shaft 7*a*, which is supported by the bottom surface of the sheet feed tray 6 at the rear end of the sheet pressing plate 7, such that the front end of the sheet pressing plate 7 moves upward and downward. Also, the sheet pressing plate 7 is biased toward the sheet feed roller 8 by a spring 7*b* from its under surface. The sheet pressing plate 7 pivots downward against the biasing force of the spring 7*b* by an amount proportional to the stacked quantity of sheets 3, and the sheets 3 are pressed into contact with the sheet feed roller 8.

The separation pad 9 is disposed in confrontation with the sheet feed roller 8 and pressed toward the sheet feed roller 8 by a spring 13 disposed on the back of the separation pad 9. The separation pad 9 nips and conveys the sheets 3 one at a time in cooperation with the sheet feed roller 8 at the time of sheet feed.

The conveying roller 11 is provided downstream from the sheet feed roller 8 with respect to the sheet feed direction. The conveying roller 11 performs conveyance of the sheets 3. The paper dust roller 14 is disposed downstream of the separation pad 9 to work cooperatively with the paper supply roller 8. Paper dust, generated by friction between a paper 3 and the separation pad 9 when supplying the paper 3, is electrostatically attracted to the paper dust roller 14. The paper dust carried on the paper is dust roller 14 is scraped off the paper dust roller 14 by a sponge 14*a*. Paper dust not completely removed from the paper 3 by the paper dust roller 14 is removed by the paper dust roller 10, so as not to allow dust into the image forming unit.

Next, the scanner unit 16 will be described in detail. The scanner unit 16 includes a laser beam emitting section (not shown), a polygon mirror 19, an fθ lens 20, reflecting mirrors 21*a*, 21*b*, and a cylinder lens 22. The laser beam emitting section is located right below the sheet discharge tray 46 and irradiates a laser beam. The polygon mirror 19 rotates to scan the laser beam from the laser beam emitting section in a main scanning direction across the surface of a photosensitive drum 27 (described later). The fθ lens 20 is for stabilizing scanning speed of the laser beam reflected from the polygon mirror 19. The reflecting mirrors 21*a*, 21*b* are for reflecting the laser beam. The cylinder lens 22 is for correcting face tangle error in a subscanning direction when laser light reflected off the mirrors 21*a* and 21*b* forms an image on the photosensitive drum 27. With this configuration, the laser beam is irradiated from the laser beam emitting section based on image data and passes through or is reflected by the polygon mirror 19, the fθ lens 20, the reflecting mirror 21*a*, the cylinder lens 22, and the reflection mirror 21*b* in this order as indicated by an alternate long and dash lines L in FIG. 1 to expose and scan the surface of the photosensitive drum 27.

Next, the process cartridge 17 will be described. The process cartridge 17 includes a drum cartridge 23 and a developing cartridge 24 that is detachably mounted on the drum cartridge 23. The drum cartridge 23 includes the photosensitive drum 27, a Scorotron charger 29, and a transfer roller 30. The developing cartridge 24 includes a developing roller 31, a supply roller 33, and a toner hopper 34. An agitator 36 is disposed within the toner hopper 34.

The photosensitive drum 27 is arranged in contact with the developing roller 31 and rotatable clockwise as indicated by an arrow in FIG. 1. The photosensitive drum 27 includes positively charging organic photo conductor coated on a conductive base material. The positively charging organic photo conductor is made from a charge transfer layer dispersed with a charge generation material on a charge generation layer. When the photosensitive drum 27 is exposed by a laser beam, the charge generation material absorbs the light and generates a charge. The charge is transferred onto the surface of the photosensitive drum 27 and the conductive base material through the charge transfer layer and counteracts the surface potential charged by the Scorotron charger 29. As a result, a potential difference is generated between regions of the photosensitive drum 27 that were exposed and regions that were not exposed by the laser light. By selectively exposing and scanning the surface of the photosensitive drum 27 with a laser beam based upon image data, an electrostatic latent image is formed on the photosensitive drum 27.

The Scorotron charger 29 is disposed above the photosensitive drum 27 at a position separated from the photosensitive drum 27 by a predetermined distance. The Scorotron charger 29 generates a corona discharge from a tungsten wire, for example, and is turned ON by a charging bias circuit unit (not shown) of a high-voltage power source circuit board 95 (described later) to positively charge the surface of the photosensitive drum 27 to a uniform charge.

The developing roller 31 is disposed further downstream than the Scorotron charger 29 with respect to the rotation direction of the photosensitive drum 27. The developing roller 31 is rotatable counterclockwise as indicated by an arrow in FIG. 1. The developing roller 31 includes a roller shaft made from metal coated with a roller made from a conductive rubber material. A development bias is applied to the developing roller 31 from a development bias circuit unit (not shown) of the high-voltage power source circuit board 95.

The supply roller 33 is rotatably disposed beside the developing roller 31 on the opposite side from the photosensitive drum 27 across the developing roller 31. The supply roller 33 is in pressed contact with the developing roller 31. The supply roller 33 is rotatable counterclockwise as indicated by an arrow in FIG. 1, which is the same rotation direction as the developing roller 31. The supply roller 33 includes a roller shaft made of metal coated with a roller made of a conductive foam material and charges toner supplied to the developing roller 31 by friction.

The toner hopper 34 is provided beside the supply roller 33 and filled with developer, which is to be supplied to the developing roller 31 by the supply roller 33. In this embodiment, non-magnetic, positive-charging, single-component toner is used as a developer. The toner is a polymeric toner obtained by copolymerizing polymeric monomers using a well-known polymerization method, such as suspending polymerization. Examples polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. A coloring agent such as carbon black, wax, and the like are mixed in the polymeric toner. An externally added agent such as silica is also added in order to improve fluidity. A particle diameter of the polymeric toner is approximately 6 to 10 μm.

The agitator 36 has a coarse mesh-like plate shape extending in the axial direction (the near-to-far direction in the drawing) and has a bend in the middle when viewed as a cross-section. A rotating shaft 35 is disposed on one end of the agitator 36, and film members 36*a* are provided on the other end of the agitator 36 and in the bend in the middle of the agitator 36 for scraping the inner wall of the toner hopper 34. The rotating shaft 35 is rotatably supported in the center of both lengthwise ends of the toner hopper 34 and, hence, supports the agitator 36. When the agitator 36 is rotated in the direction indicated by the arrow, toner accommodated in the toner hopper 34 is agitated.

A transfer roller 30 is disposed below the photosensitive drum 27 and downstream from the developing roller 31 with respect to the rotating direction of the photosensitive drum 27. The transfer roller 30 is rotatable counterclockwise as indicated by an arrow in FIG. 1. The transfer roller 30 includes a metal roller shaft coated with a roller made from an ion-conductive rubber material. During the transfer process, a transfer bias circuit unit (not shown) of the high-voltage power source circuit board 95 applies a transfer bias to the transfer roller 30. The transfer bias generates a potential difference between the surfaces of the photosensitive drum 27 and the transfer roller 30. The potential difference electrically attracts toner that electrostatically clings to the surface of the photosensitive drum 27 to the surface of the transfer roller 30.

Next, the fixing unit 18 will be described. The fixing unit 18 includes a fixing roller 41, a pressing roller 42 for pressing the fixing roller 41, and a pair of conveying rollers 43. The conveying rollers 43 are provided downstream of the fixing roller 41 and the pressing roller 42. The fixing roller 41 is formed by coating a hollow aluminum roller with a fluorocarbon resin and sintering the assembly. The fixing roller 41 includes a metal tube and a halogen lamp for heating inside the metal tube. The pressing roller 42 includes a silicon rubber shaft having low hardness that is covered by a tube formed of a fluorocarbon resin. The silicon rubber shaft is urged upward by a spring (not shown), pressing the pressing roller 42 against the fixing roller 41. While the sheet 3 from the process cartridge 17 passes between the fixing roller 41 and the pressing roller 42, the fixing roller 41 pressurizes and heats toner that was transferred onto the sheet 3 in the process cartridge 17, thereby fixing the toner onto the sheet 3. Afterward, the sheet 3 is transported to the sheet delivery path 44 by the conveying rollers 43.

Next, the duplex printing unit 26 will be described. The duplex printing unit 26 is disposed above the paper supply cassette 6 and includes reverse conveying rollers 50*a*, 50*b*, and 50*c* arranged in a substantially horizontal orientation. A reverse conveying path 47*a* is provided on the rear side of the reverse conveying roller 50*a*, while a reverse conveying path 47*b* is provided on the front side of the reverse conveying roller 50*c*. The reverse conveying path 47*a* is disposed on an inner surface side of the rear cover 48. The reverse conveying path 47*a* extends from the discharge roller 45 to the reverse conveying rollers 50*a* and branches off from the sheet delivery path 44 near the end of the same in the sheet feed direction of the paper 3. The reverse conveying path 47*b*, on the other hand, extends from the reverse conveying roller 50*c* to the register rollers 12.

When performing duplex printing, an image is first formed on one side of the paper 3, after which a portion of the paper 3 is discharged onto the sheet discharge tray 46. When the trailing edge of the paper 3 becomes interposed between the discharge rollers 45, the discharge rollers 45 stop rotating forward and begin rotating in reverse. At this time, the trailing edge of the paper 3 contacts the arcuate surface of the sheet delivery path 44 and is guided along this surface to the reverse conveying path 47*a*, without returning to the fixing unit 18. The paper 3 is conveyed from the reverse conveying path 47*a* to the reverse conveying rollers 50*a*, 50*b*, and 50*c* and further of the reverse conveying path 47*b*. The paper 3 is subsequently guided to the register rollers 12 along the reverse conveying path 47*b*. According to this operation, the paper 3 is conveyed to the image forming unit with its front and back surfaces switched in order to form a prescribed image on the other side of the paper 3.

A low-voltage power source circuit board 90, the high-voltage power source circuit board 95, and an engine circuit board 85 are provided between the duplex printing unit 26 and the image forming unit. A chute 80 is disposed between these circuit boards 90, 95, and 85 and the image forming unit for separating these circuit boards 90, 95, 85 from the fixing unit 18, the processing cartridge 17, and other devices. Guide plates 81 are provided on the top of the chute 80, constructing a portion of the conveying path for the paper 3.

The low-voltage power source circuit board 90 functions to drop the voltage supplied from a source external to the laser printer 1, such as a single-phase 100V source, to a voltage of 24V, for example, to be supplied to components in the laser printer 1. The high-voltage power source circuit board 95 generates a high-voltage bias that is applied to components in the processing cartridge 17.

The engine circuit board 85 drives a DC motor (not shown), which is the source for driving parts involved in mechanical operations, such as the rollers in the laser printer 1, a solenoid (not shown) for switching the operating direction of this drive system, and the like.

A control circuit board (not shown) for controlling each device in the laser printer 1 is provided at a position near the rear surface of the main casing 2 and between the left side surface of the main casing 2 (the near side in the drawing) and the left frame 100. The control circuit board is disposed along a plane substantially parallel to the left side surface of the main casing 2.

Next, operations of the laser printer 1 during printing will be described with reference to FIG. 1. The sheet 3 located at the top among the sheets stacked on the sheet pressing plate 7 is pressed toward the sheet feed roller 8 by the spring 7*b* from the back of the sheet pressing plate 7. When printing is started, the sheet 3 is fed by frictional force between the sheet 3 and the rotating sheet feed roller 8 to a position between the sheet feed roller 8 and the separation pad 9. Then, the sheet feed roller 8 and the separation pad 9 together transport the sheets 3 one at a time to the registration roller 12.

The laser beam emitting section (not shown) of the scanner unit 16 generates a laser beam based upon a laser drive signal generated by the engine circuit board 85. The laser beam falls incident on the polygon mirror 19. The polygon mirror 19 provides the laser beam with a scan movement in a main scanning direction (direction perpendicular to the conveying direction of the sheet 3) while reflecting the laser beam toward the fθ lens 20. The fθ lens 20 converts the laser beam to a constant angular speed. Then, the reflecting mirror 21*a* reflects the laser beam toward the cylinder lens 22, which converges the laser beam. The reflecting mirror 21*b* reflects the converged laser beam to focus on the surface of the photosensitive drum 27.

The Scorotron charger 29 charges the surface of the photosensitive drum 27 to, for example, a surface potential of approximately 1000V. The laser beam from the scanner unit 16 scans across the surface of the photosensitive drum 27 in the main scan direction. The laser beam selectively exposes and does not expose the surface of the photosensitive drum 27 based on the laser drive signal described above. That is, portions of the surface of the photosensitive drum 27 that are to be developed are exposed by the laser light and portions that are not to be developed are not exposed. The surface potential of the photosensitive drum 27 decreases to, for example, approximately 200V at exposed portions (bright parts). Because the photosensitive drum 27 rotates clockwise as indicated by an arrow in FIG. 1 at this time, the laser beam also exposes the photosensitive drum 27 in an auxiliary scanning direction, which is also the conveying direction of the sheet 3. As a result of the two scanning actions, an electrical invisible image, that is, an electrostatic latent image is formed on the surface of the photosensitive drum 27 from exposed areas and unexposed areas (dark parts).

The toner in the toner hopper 34 is supplied to the supply roller 33 according to the rotation of the agitator 36. At this point, the toner is frictionally charged positively between the supply roller 33 and the developing roller 31 and is further regulated to a layer with uniform thickness. Then, the toner is borne on the developing roller 31. A positive bias of, for example, approximately 400V is applied to the developing roller 31. The toner, which is borne on the developing roller 31 and charged positively, is transferred to the electrostatic latent image formed on the surface of the photosensitive drum 27 when the toner comes into contact with the photosensitive drum 27. That is, because the potential of the developing roller 31 is lower than the potential of the dark parts (+1000V) and higher than the potential of the bright parts (+200V), the positively-charged toner selectively moves to the bright parts where the potential is lower. In this way, a visible image of toner is formed on the surface of the photosensitive drum 27.

The registration rollers 12 perform a registration operation on the sheet 3 to deliver the sheet 3 so that the front edge of the visible image formed on the surface of the rotating photosensitive drum 27 and the leading edge of the sheet 3 coincide with each other. A negative constant voltage (−1000V, for example) is applied to the transfer roller 30 while the sheet 3 passes between the photosensitive drum 27 and the transfer roller 30. Because the negative constant voltage that is applied to the transfer roller 30 is lower than the potential of the bright part (+200V), the toner electrostatically clinging to the surface of the photosensitive drum 27 moves toward the transfer roller 30. However, the toner is blocked by the sheet 3 and cannot transfer to the transfer roller 30. As a result, the toner is transferred onto the sheet 3. In this manner, the visible image formed on the surface of the photosensitive drum 27 is transferred onto the sheet 3.

It should be noted that the laser printer 1 employs what is known as a cleanerless developing system, wherein the developing roller 31 recovers toner remaining on a surface of the photosensitive drum 27 after the transfer roller 30 transfers toner from the photosensitive drum 27 to the paper 3.

Then, the sheet 3 having the toner transferred thereon is conveyed to the fixing unit 18. The fixing roller 41 of is the fixing unit 18 applies heat of approximately 200 degrees, and the pressing roller 42 applies a pressure, to the sheet 3 with the toner image to fix the toner image permanently on the sheet 3. Note that the fixing roller 41 and the pressing roller 42 are each grounded through diodes so that the surface potential of the pressing roller 42 is lower than the surface potential of the fixing roller 41. Accordingly, the positively charged toner that Clings to the fixing roller 41 side of the sheet 3 is electrically attracted to the lower surface potential of the pressing roller 42. Therefore, the potential problem of the toner image being distorted because the toner is attracted to the fixing roller 41 at the time of fixing is prevented.

The sheet delivery roller 43 discharges the sheet 3 with the fixed toner image from the fixing unit 18 and conveys the sheet 3 on the sheet delivery path 44. The sheet delivery roller 45 delivers the sheet 3 to the sheet discharge tray 46 with a toner image side facing downward. Similarly, the sheet 3 to be printed next is stacked over the earlier delivered sheet 3 with a printed surface facing downward in the sheet discharge tray 46. In this way, a user can obtain the sheets 3 aligned in the order of printing.

In subsequent drawings, the −Y direction, −X direction, +X direction, +Y direction, +Z direction, and −Z direction correspond respectively to the frontward, leftward, rightward, rearward, upward, and downward directions in relation to the laser printer 1.

As shown in FIG. 1, when printing on a paper 3 stacked in the paper supply cassette 6, the paper 3 is conveyed through the laser printer 1 along an S-shape conveying path and discharged onto the sheet discharge tray 46. Normally, the paper 3 is an inexpensive paper of a fixed size (A4 size for example) and is thin and easily bendable, such as copy paper. However, when printing on a recording medium that is difficult to bend or sensitive to bending (hereinafter referred to as "hand-fed paper"), such as thick paper, postcards, and transparencies, there are many problems associated with feeding this type of recording medium from the paper supply cassette 6. Accordingly, the laser printer 1 is configured to convey such hand-fed paper along a substantially straight conveying path so as not to impose a load on the paper from bending. That is, hand-fed paper is guided into an A section of the laser printer 1 through the front surface thereof. The hand-fed paper is conveyed along a path through the image forming unit to be printed and subsequently discharged from the rear surface of the laser printer 1 through a B section that is exposed when the rear cover 48 and the sheet delivery path 44 are pivoted downward to open. In order to convey the hand-fed paper into the A section, the multipurpose unit 200 or the manual feed unit 300 is selectively mounted in the front surface of the main casing 2. The multipurpose unit 200 and the manual feed unit 300 have differing functions based on the model.

Figure 2:
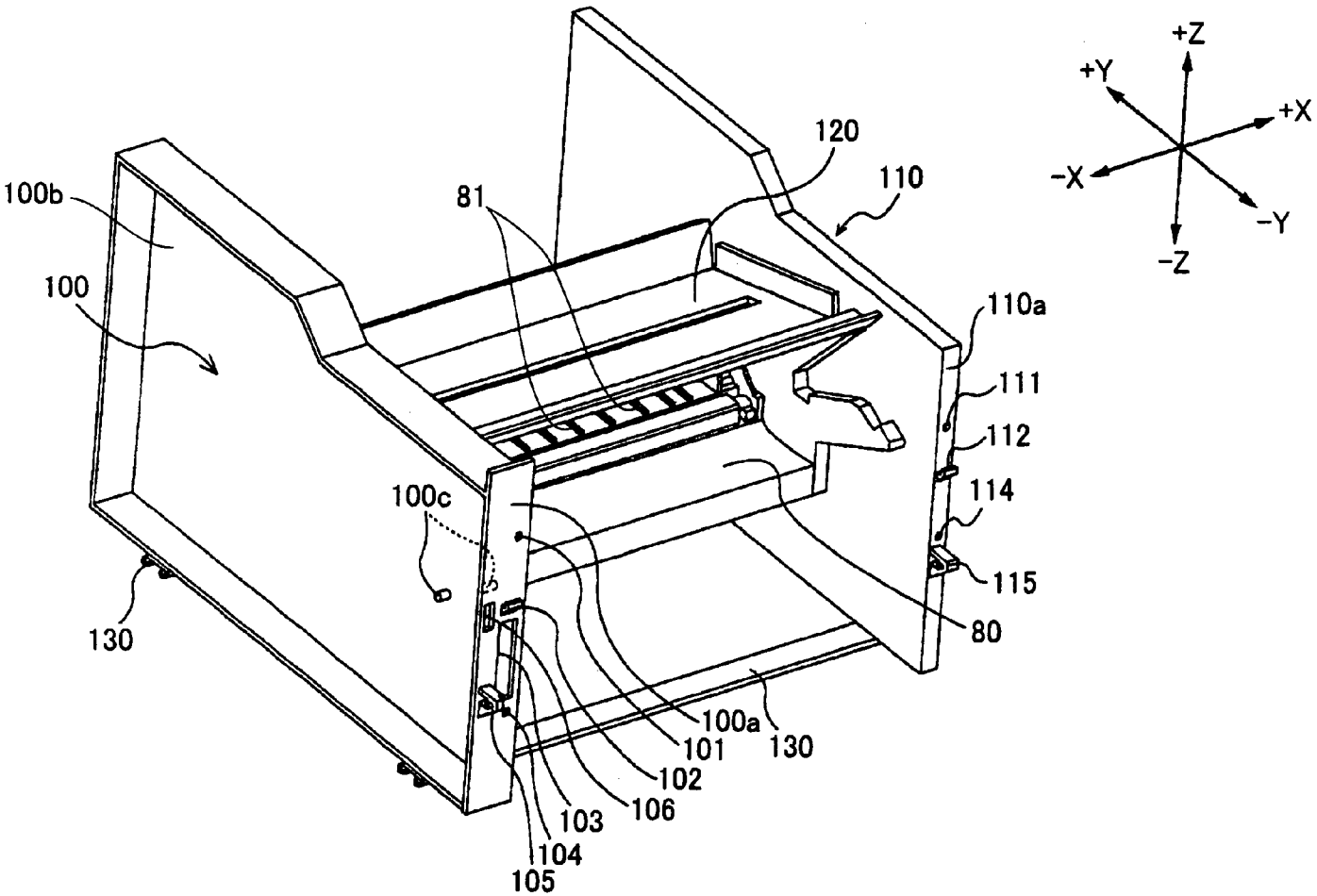
FIG. 2 is a perspective view from the right front of the laser printer showing left and right frames thereof.

As shown in FIG. 2, the left and right frames 100 and 110 formed in substantially rectangular shapes are provided in the main casing 2 for supporting, from the left and the right, various components including the paper supply cassette 6, the scanning unit 16, the processing cartridge 17, the fixing unit 18, and the conveying system. A tray 120 bridges the left and right frames 100 and 110 in the upper part for supporting the scanning unit 16. The chute 80 bridges the left and right frames 100 and 110 in the middle part for covering the top of the low voltage power supply circuit board 90, the high voltage power supply circuit board 95, and the like (see FIG. 1). Two underbars 130 bridge the left and right frames 100 and 110 in the lower part. In this manner, the tray 120, the chute 80, and the underbars 130 fix the positional relationship of the left and right frames 100 and 110. The left and right frames 100 and 110 are formed in the shape of trays whose bottom surfaces oppose one another. While not shown in the drawings, the left frame 100 is internally provided with a DC motor for driving various devices in the feeder section 4 and the image forming unit, a driving system that includes gears, a solenoid, and the like for transferring the driving force of the DC motor, the control circuit board, and the like. The right frame 110 accommodates a fan (not shown) for exhausting air from and cooling the laser printer 1. A construction for mounting the multipurpose unit 200 and the manual feed unit 300 is provided on side walls 100*a* and 110*a* on the front (the −Y direction side) of the left and right frames 100 and 110, which will be described next in detail.

As shown in FIG. 2, provided on the side wall 100*a* of the left frame 100 are a substantially rectangular shaped gear hole 103 that penetrates the side wall 110*a* in substantially the center portion in the Z direction (vertical direction), screw holes 101 and 104 disposed above and directly below the gear hole 103 respectively, a hooking pawl 102 disposed directly above the gear hole 103, a bearing protrusion 105, and a hole 106 formed near the hooking pawl 102. A screw receiver 100*c* protrudes from the bottom plate 100*b* of the left frame 100 near the gear hole 103.

As with the left frame 100, the side wall 110*a* of the right frame 110 is provided with a hooking pawl 112 disposed slightly above center of the side wall 110*a* in the Z direction, screw holes 111 and 114 formed above and below the hooking pawl 112, and a bearing protrusion 115 protruding from below the screw hole 114.

With this mounting construction, the multipurpose unit 200 and the manual feed unit 300 can be selectively mounted on the left and right frames 100 and 110 in a manner described later.

Figure 4:
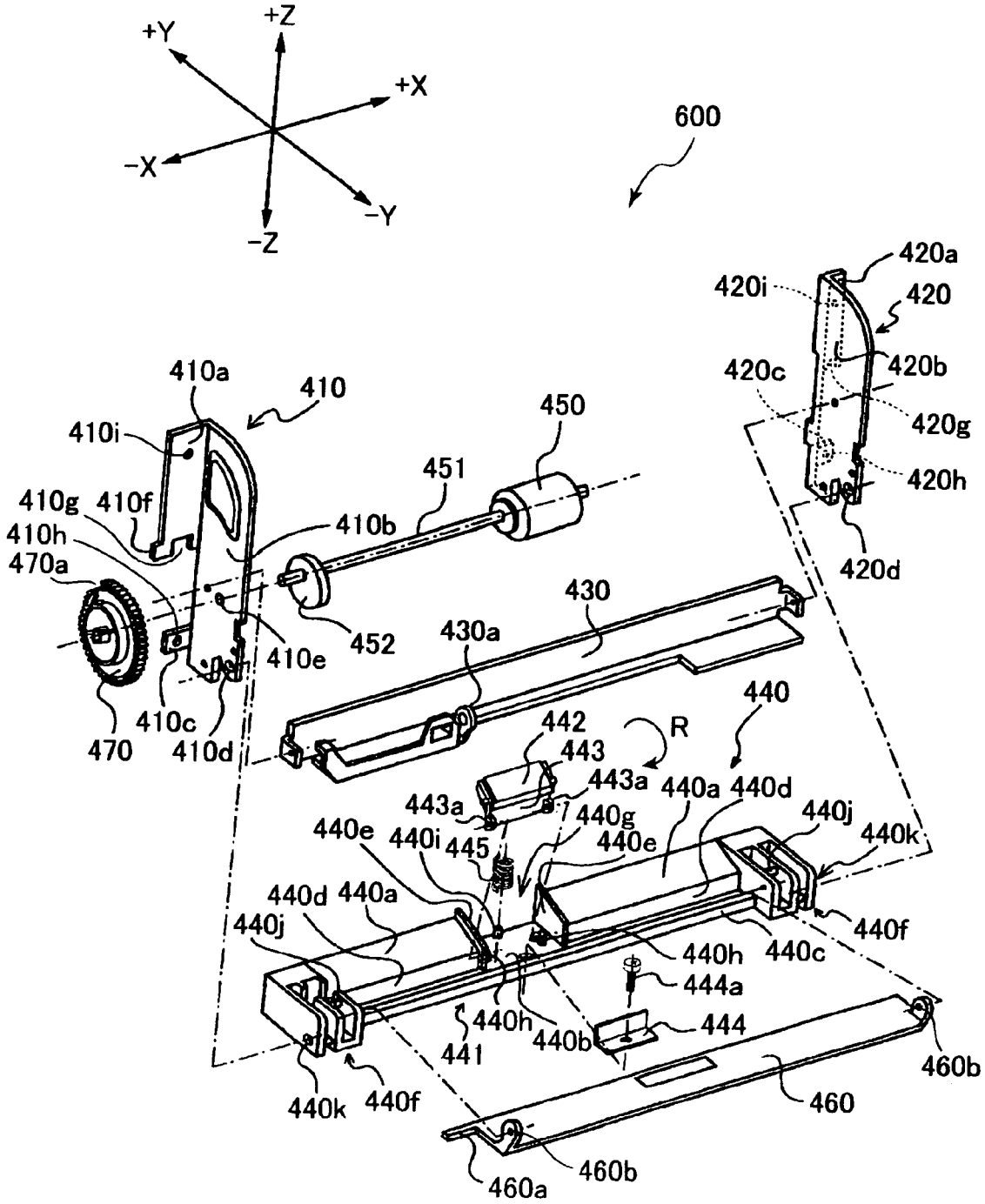
FIG. 4 is an exploded perspective view in partial phantom showing the left and right mounting frames and the supply mechanism.
Figure 6:
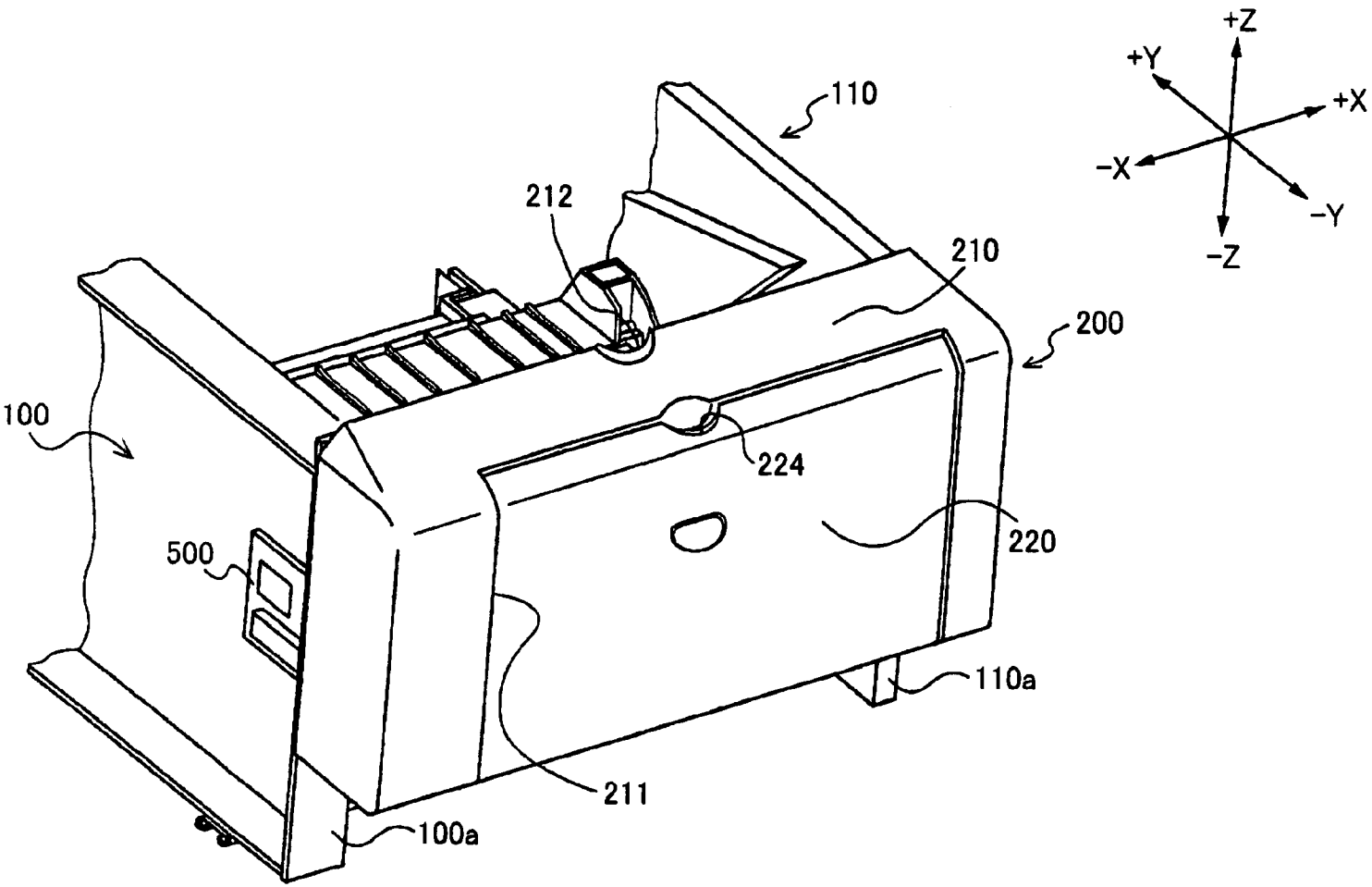
FIG. 6 is a perspective view showing the appearance of a multipurpose unit mounted on the left and right frames.

The multipurpose unit 200 includes a supplying/mounting mechanism 600 shown in FIG. 4, and a cover body 210 and a multipurpose tray 220 shown in FIG. 6. The manual feed unit 300, on the other hand, includes a cover body 310 and a manual feed tray 320 shown in FIG. 9. While not as thick as the multipurpose unit 200, the manual feed unit 300 has substantially the same outer surface area as the multipurpose unit 200.

Figure 9:
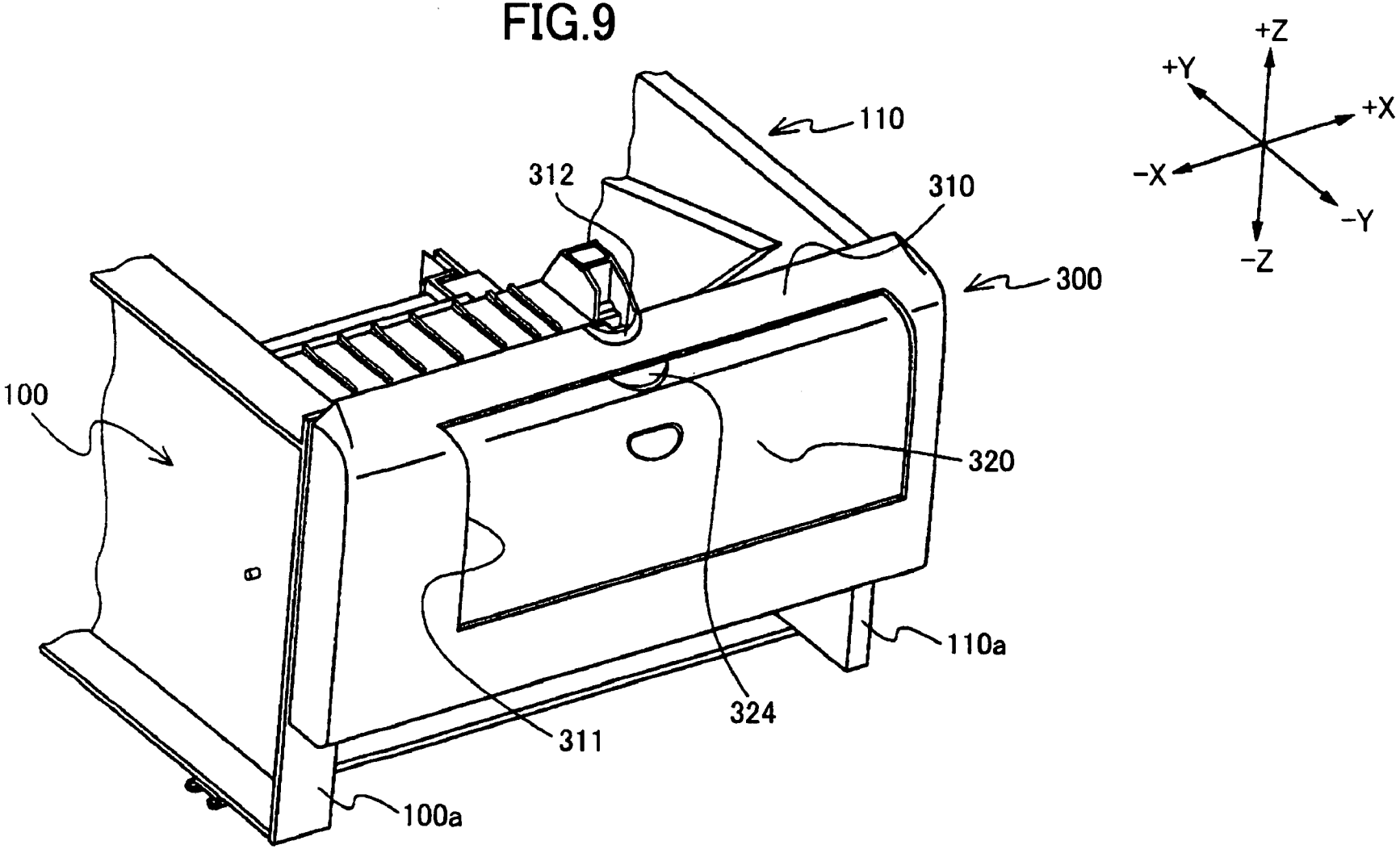
FIG. 9 is a perspective view showing the appearance of a manual feed unit mounted on the left and right frames.

As shown in FIGS. 6 and 9, the multipurpose unit 200 and the manual feed unit 300 function as covers for covering the mounting hole 57 (FIG. 1). The interior of the laser printer 1 is exposed by opening the cover body 210 or the cover body 310, enabling the processing cartridge 17 to be inserted or removed via the mounting hole 57. The multipurpose tray 220 and the manual feed tray 320 are accommodated in tray accommodating sections 211 and 311 formed in the cover bodies 210 and 310, respectively, and together with the cover bodies 210 and 310 form the outer wall on the front surface of the main casing 2. FIG. 6 shows an external view of the integrated cover body 210 and the multipurpose tray 220. FIG. 9 shows an external view of the manual feed unit 300 when the cover body 310 and the manual feed tray 320 are integrated.

Figure 8:
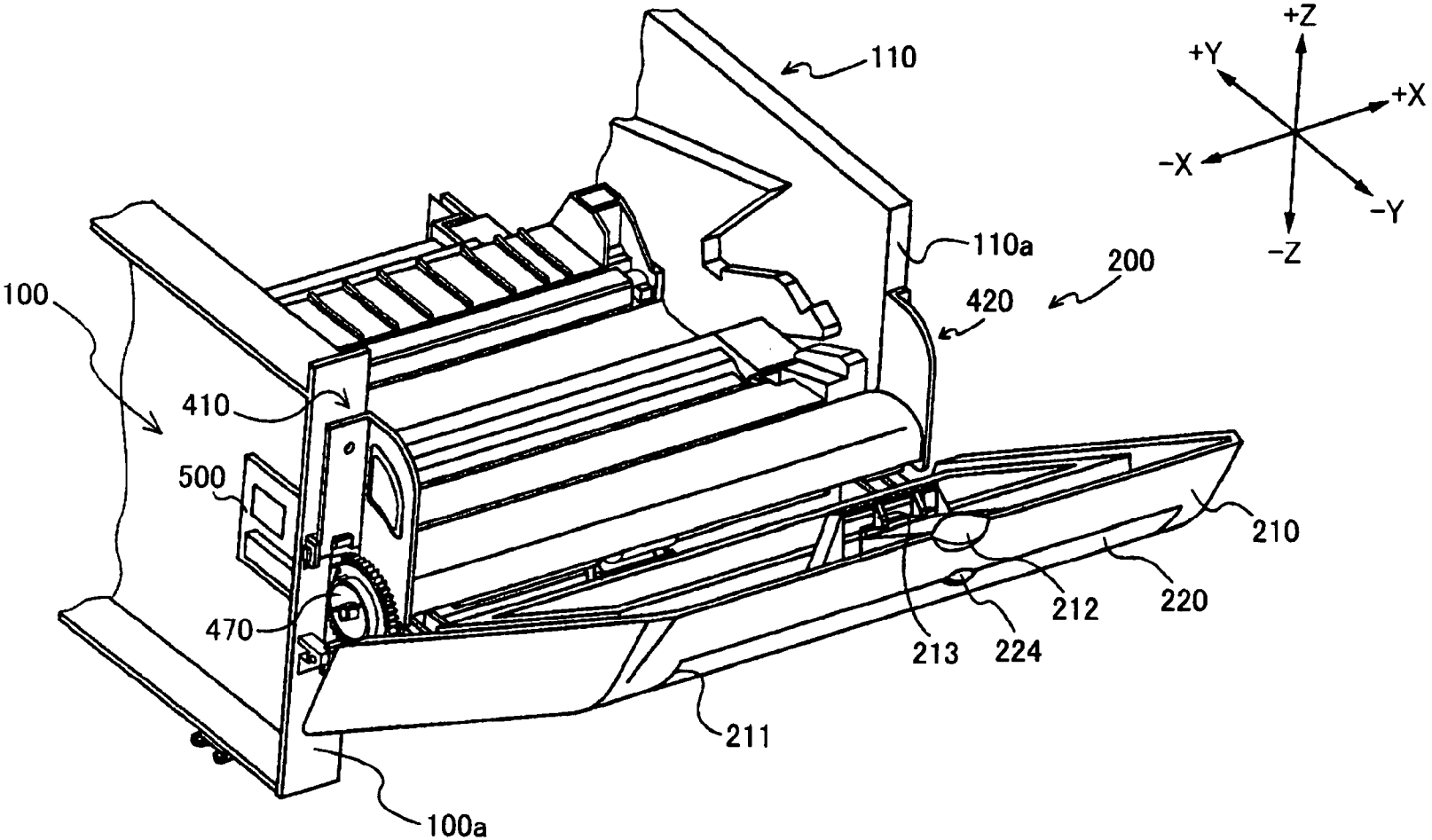
FIG. 8 is a perspective view showing a cover body of the multipurpose unit in an open state.
Figure 11:
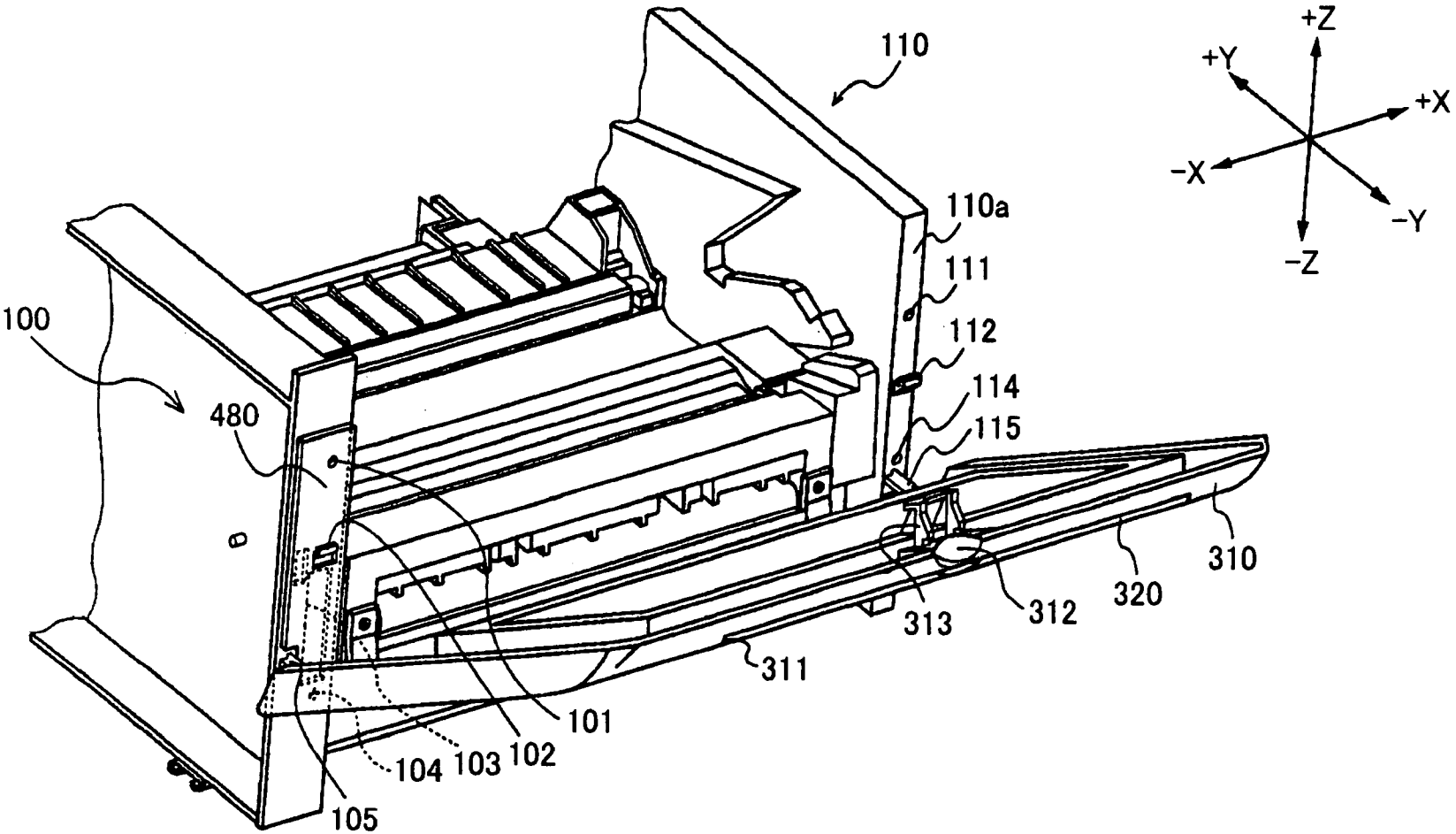
FIG. 11 is a perspective view showing a cover body of the manual feed unit in an open state.
Figure 14:
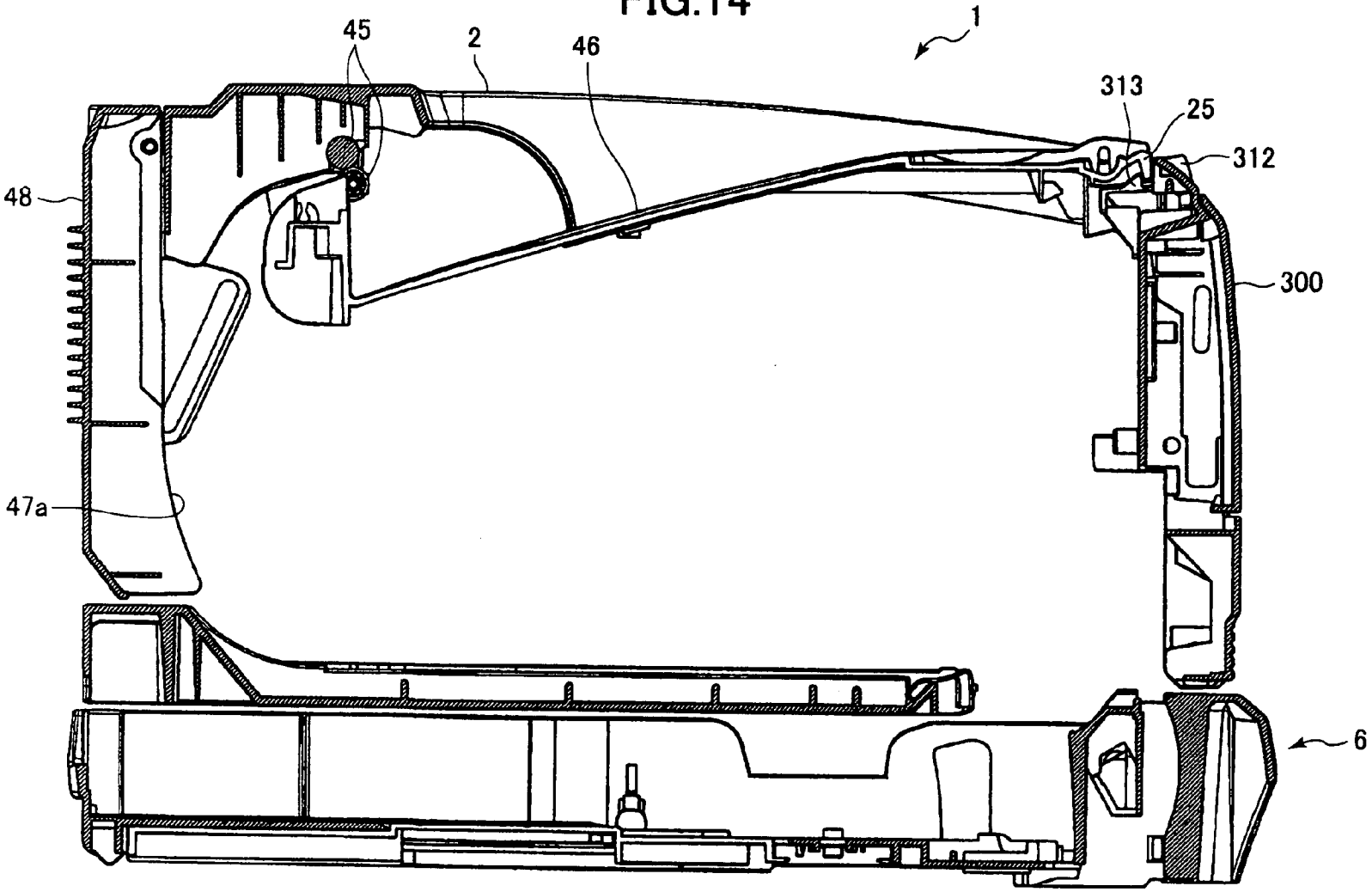
FIG. 14 is a cross-sectional side view of the laser printer.

As shown in FIGS. 6 and 9, release buttons 212 and 312 are disposed on the free ends of the cover bodies 210 and 310, respectively, in approximately the center of the edge portion thereof, providing the user with a finger hold for opening and closing the cover bodies 210 and 310. As shown in FIGS. 8 and 11, hooks 213 and 313 are disposed near the release buttons 212 and 312 on the inside surface of the cover bodies 210 and 310, respectively. When the cover bodies 210 and 310 are closed, the hooks 213 and 313 engage an engaging unit 25 provided on the top surface of the main casing 2 shown in FIG. 14, thereby maintaining the cover bodies 210 and 310 in a closed state. The user can open the cover bodies 210 and 310 by pressing the release buttons 212 and 312 in a direction toward an open/close shafts (downward in this embodiment) in order to disengage the hooks 213 and 313 from the engaging unit 25. In other words, the user must always operate the release buttons 212 and 312 when opening the cover bodies 210 and 310. Hence, this construction insures that the load placed on the cover bodies 210 and 310 for opening the same is only applied from the position of the release buttons 212 and 312, preventing the user from opening the cover bodies 210 and 310 by gripping the side surfaces of the same, for example. Accordingly, the load can be distributed in a substantially even manner across the shafts of the cover bodies 210 and 310, thereby preventing damage to the open/close shafts and preventing bending of the cover bodies 210 and 310. This type of construction designed to avoid damage by requiring operations to be performed in a predetermined order is called a foolproof construction.

The multipurpose unit 200 will be described in greater detail. As described above, the multipurpose unit 200 includes the supplying/mounting mechanism 600, the cover body 210, and the multipurpose tray 220. First, the supplying/mounting mechanism 600 will be described.

As shown in FIG. 4, the supplying/mounting mechanism 600 includes a left mounting frame 410, a right mounting frame 420, a bridging frame 430, a chute 440, a paper pressing plate 460, and a separating mechanism 441.

Figure 3:
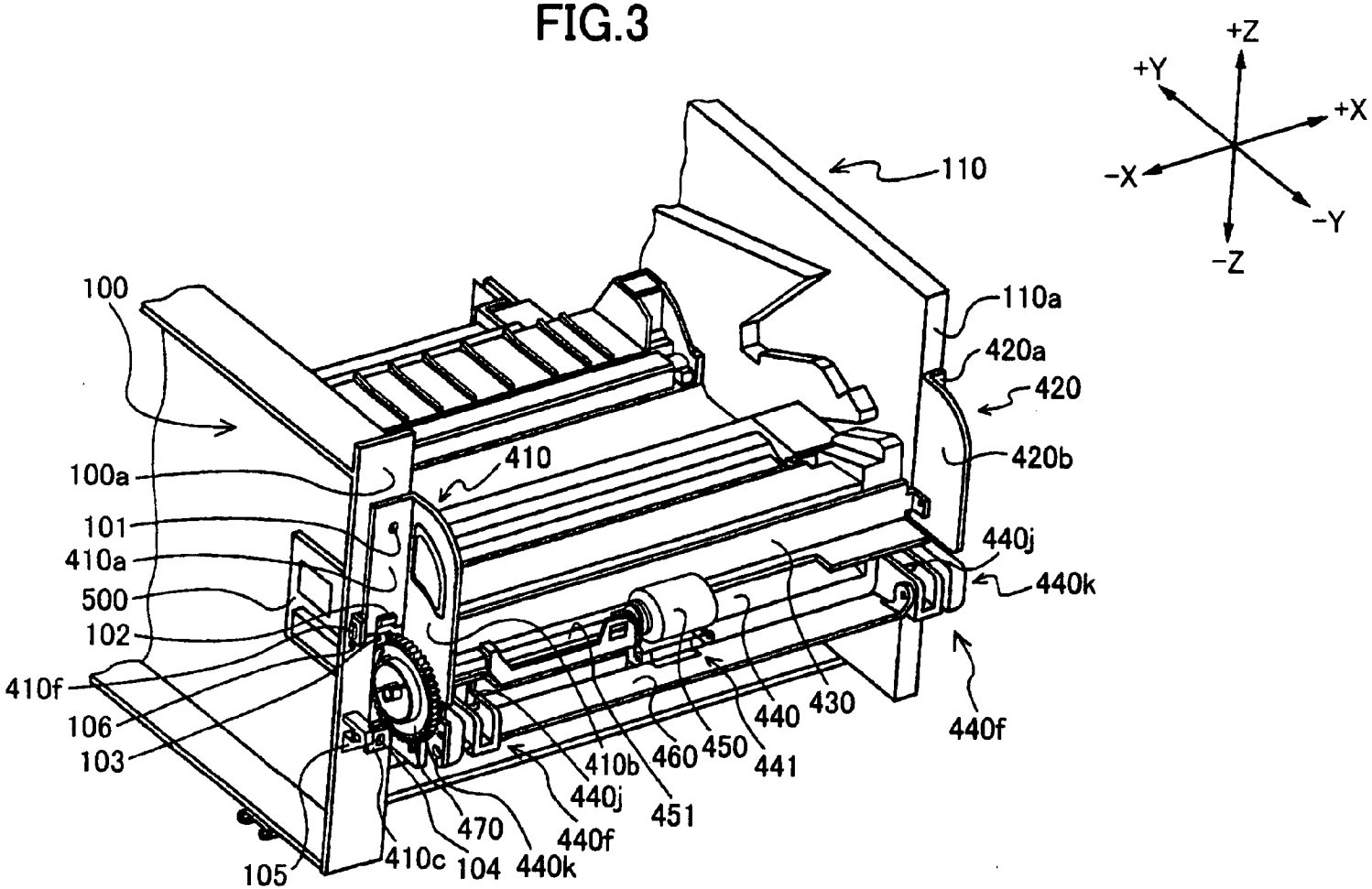
FIG. 3 is a perspective view showing left and right mounting frames fixed to the left and right frames and a supply mechanism.

The left mounting frame 410 is a metal plate that fixes to the left frame 100. As shown in FIGS. 3 and 4, the left mounting frame 410 includes integrally formed plates 410*a*, 410*b*, and 410*c*. When mounting the left mounting frame 410 on the left frame 100, the plate 410*b* is arranged parallel to the bottom surface 100*b* of the left frame 100, and the plates 410*a* and 410*c* are parallel to the side wall 100*a*. The top front corner portion of the plate 410*b* is cut into an arc shape. The length of the plate 410*b* in the Z direction is slightly longer than the distance between the screw holes 101 and 104 (FIG. 2). The width of the plate 410*b* in the Y direction (front-to-back direction) is slightly shorter than the thickness of the cover body 210 (FIG. 6), so that the plate 410*b* can fit inside the cover body 210 when the cover body 210 is closed. A bearing hole 410*e* is formed in the plate 410*b* slightly below the center thereof. The plate 410*a* is substantially rectangular in shape and is longer in the vertical direction (Z direction), extending from the top end of the plate 410*b* to the midpoint thereof. The plate 410*a* protrudes leftward (−X) from the side edge on the back side of the plate 410*b*. The plate 410*c* is large enough to cover the screw hole 104 and, like the plate 410*a*, protrudes leftward from the bottom portion of the plate 410*b*.

A cutout portion 410*g* is formed in the bottom edge of the plate 410*a*, while a screw hole 410*i* is formed in the top end thereof. A screw hole 410*h* is formed in the plate 410*c*. A protrusion 410*f* is provided in the plate 410*a* near the cutout portion 410*g*. A shaft hole 410*d* is formed in the bottom front corner of the plate 410*b*. When mounting the left mounting frame 410 on the left frame 100, the position of the left mounting frame 410 is determined by engaging the cutout portion 410*g* with the hooking pawl 102. The screw hole 410*i* is aligned with the screw hole 101, and the screw hole 410*h* is aligned with the screw hole 104. Then, the left mounting frame 410 is fixed to the left frame 100 by inserting screws into the aligned holes.

As shown in FIG. 4, the right mounting frame 420 has a shape almost identical to the mirror image of the left mounting frame 410 and includes a plate 420*b* with an arc-shaped upper front corner, a substantially rectangular shaped plate 420*a* that extends from the top edge to the center of the plate 420*b* and protrudes rightward from the rear edge thereof, and a plate 420*c* that protrudes rightward from the bottom edge of the plate 420*b*. A cutout portion 420*g* and a screw hole 420*i* are formed in the plate 420*a*, while a screw hole 420*h* is formed in the plate 420*c*. A shaft hole 420*d* is formed in the bottom front corner of the plate 420*b*.

When mounting the right mounting frame 420 on the right frame 110, the position of the right mounting frame 420 is determined by engaging the cutout portion 420*g* with the hooking pawl 112. The screw hole 420*i* is aligned with the screw hole 111, and the screw hole 420*h* is aligned with the screw hole 114. Then, the right mounting frame 420 is fixed to the right frame 110 by inserting screws into these aligned holes.

The bridging frame 430 and the chute 440 bridge the left mounting frame 410 and the right mounting frame 420, such that the relative positions of the left mounting frame 410 and the right mounting frame 420 are fixed. The bridging frame 430 is a metal frame having a length equivalent to the width between the left frame 100 and the right frame 110 and is formed of plates having a cross-sectional L-shape. Both ends of the bridging frame 430 are fixed to the left mounting frame 410 and the right mounting frame 420 by screws near the center portions thereof, respectively. A bearing 430*a* is disposed on the bridging frame 430 slightly left of the center portion thereof. A paper supply roller 450 is disposed near the lengthwise center of the bridging frame 430. The paper supply roller 450 is detachably mounted on the right end of a rotating shaft 451. The rotating shaft 451 has a length approximately half that of the bridging frame 430. The rotating shaft 451 is supported by the bearing 430*a* and the bearing hole 410*e* in the left mounting frame 410. A cam 452 is mounted on the left end of the rotating shaft 451 to the right of the plate 410*a*, while a gear 470 is mounted on the same end of the rotating shaft 451 to the left of the plate 410*a*. The gear 470 transfers a driving force to the paper supply roller 450 via the rotating shaft 451. The gear 470 includes gear teeth around the outer periphery thereof, but teeth are missing in a toothless section 470*a* on the outer periphery.

The chute 440 is formed of a resinous material combined with glass fibers or other reinforcing materials to aid the chute 440 in resisting bending. The chute 440 is positioned directly below the bridging frame 430 and includes a bottom plate 440*b*, a side plate 440*c*, two side plates 440*d*, and a pair of support units 440*f*. The bottom plate 440*b* is formed in a long slender plate shape. The side plate 440*c* is mounted on the front edge of the bottom plate 440*b* and extends above the top surface of the bottom plate 440*b*. The side plates 440*d* are wider than the side plate 440*c* in the Y direction. The side plates 440*d* are disposed on the top surface of the bottom plate 440*b* and extend along the rear edge thereof. The side plate 440*d* on the right side extends from the right edge to near the center portion of the bottom plate 440*b*, while the side plate 440*d* on the left side extends from the left edge to near the center portion of the bottom plate 440*b*, such that a gap is formed between the two. Sloped surfaces 440*a* are formed on the top surfaces of the side plates 440*d*, sloping down toward the front. The sloped surfaces 440*a* serve to guide a paper 3 into the A section (FIG. 1) when feeding the paper 3.

Side plates 440*e* are disposed on the inside surfaces of the side plates 440*d* to cover the ends thereof. A recess 440*g* is formed in the area between the opposing side plates 440*e*. The wide surfaces of the side plates 440*e* are orthogonal to the wide surface of the bottom plate 440*b*. A pair of support shafts 440*h* and protrusion 440*i* are disposed on the bottom surface of the recess 440*g*.

The support units 440*f* are mounted on the left and right ends of the bottom plate 440*b* and include three plates formed in a stacked structure with gaps therebetween. Each plate has a substantially rectangular shape and is slightly longer than the bottom plate 440*b* in the Y direction and has a width substantially equivalent to the height of the side plates 440*d* (Z direction). Support shafts 440*j* are disposed one between each of the inner two plates, extending orthogonally thereto. The support shafts 440*j* function as shafts for rotating the multipurpose tray 220 as will be described later. Shaft holes 440*k* are formed in the corners of the outermost plates in the support units 440*f*. The axes of the shaft holes 440*k* are positioned near the axes of the support shafts 440*j*.

The shaft holes 440*k* are aligned with the shaft holes 410*d* and 420*d* formed in the left mounting frame 410 and the right mounting frame 420, and the rotational shaft of the cover body 210 is inserted therethrough. In this manner, the chute 440 is connected to the left and right mounting frames 410, 420.

The paper pressing plate 460 has a length substantially equivalent to the distance between the support units 440*f* and a width sufficient to reach the front edges of the side plates 440*d* from the, front edges of the support units 440*f*. A pair of bearings 460*b* is provided in the front of the paper pressing plate 460, with one on either lengthwise end. The paper pressing plate 460 is rotatably supported by the support units 440*f* through the bearings 460*b*. A spring not shown in the drawings is provided below the rear edge of the paper pressing plate 460 and urges the rear edge of the paper pressing plate 460 to press upward against the paper supply roller 450 in the +Z direction. An operating piece 460*a* protrudes from the left rear corner of the paper pressing plate 460. The operating piece 460*a* follows the cam 452 provided on the rotating shaft 451 such that the rear edge of the paper pressing plate 460 is moved up and down.

The separating mechanism 441 is supported in the recess 440*g* of the chute 440 and works cooperatively with the paper supply roller 450 for supplying paper. The separating mechanism 441 includes a separating pad 442, a supporting member 443, a regulating member 444, and a spring 445. The separating pad 442 works in cooperation with the paper supply roller 450 for separating a single sheet 3 from a plurality of stacked sheets of paper.

Figure 12:
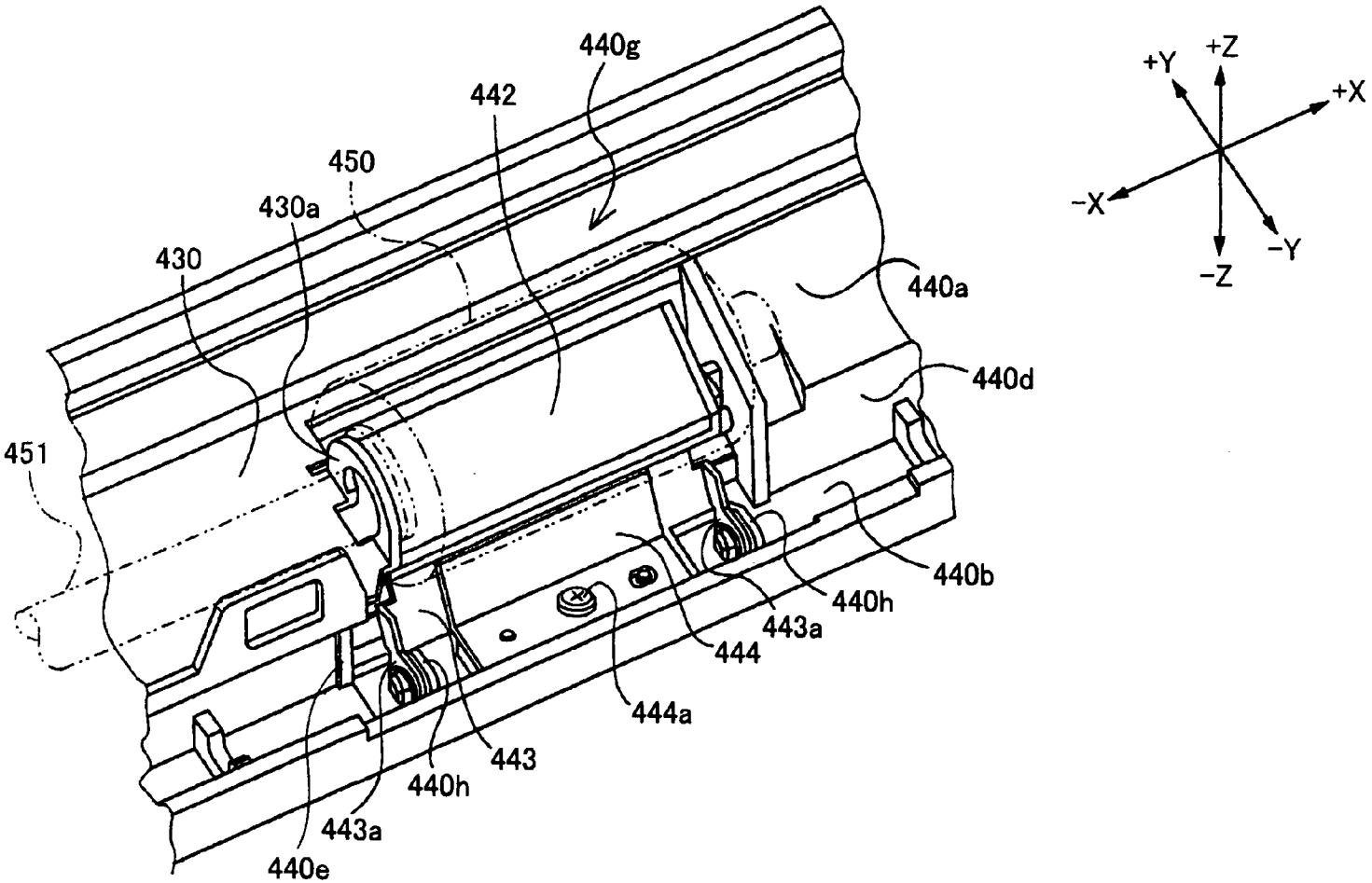
FIG. 12 is an enlarged perspective view showing the relevant section of the supply mechanism.

As shown in FIGS. 4 and 12, the supporting member 443 is a substantially rectangular metal plate that has been bent along a line running lengthwise therethrough to form an L-shaped cross section. The separating pad 442 is mounted on an outer surface of the supporting member 443. The left and right ends of the other outer surface on the supporting member 443 are bent outward in a direction orthogonal to this external surface, forming two bearing plates 443*a*. A shaft hole is formed in each bearing plate 443*a*. The shaft holes formed in the bearing plates 443*a* are engaged with the support shafts 440*h* provided in the recess 440*g* of the chute 440 such that the separating pad 442 on the supporting member 443 faces upward. In this way, the supporting member 443 is capable of swinging in the recess 440*g* about the support shafts 440*h*.

One end of the spring 445 engages the protrusion 440*i* provided in the recess 440*g*, while the other end urges the separating pad 442 via the supporting member 443 to move upward in the +Z direction, that is, to separate from the bottom plate 440*b*. With this construction, the supporting member 443 is urged to rotate about the support shafts 440*h* in a direction indicated by an arrow R.

The regulating member 444 regulates the rotational range of the supporting member 443, such that the supporting member 443 does not swing farther than a prescribed range. The regulating member 444 is a substantially rectangular metal plate that has been bent into an L-shape. One external surface of the regulating member 444 is fixed by a screw 444*a* onto the top of the bottom plate 440*b*, such that the other outer surface of the regulating member 444 opposes the outer surface of the supporting member 443 on which the separating pad 442 is not fixed.

Next, the cover body 210 will be described. As shown in FIG. 6, the cover body 210 has a thick plate shape with a length in the X direction (left-to-right direction) slightly longer than the distance between the left frame 100 and the right frame 110, and a width in the Z direction (height) about two-thirds the height of the laser printer 1.

A pair of rotational shafts not shown in the drawing is provided at the bottom of the cover body 210, with one each on the left and right ends. The rotational shafts are coupled with the shaft holes 440*k* in the chute 440 and the shaft holes 410*d* and 420*d* in the left and right mounting frames 410 and 420 described above (FIG. 4). With this construction, while the multipurpose unit 200 is mounted on the laser printer 1, the cover body 210 can be swung widely open as shown in FIG. 8, while the multipurpose tray 220 is accommodated in the tray accommodating section 211.

Figure 7:
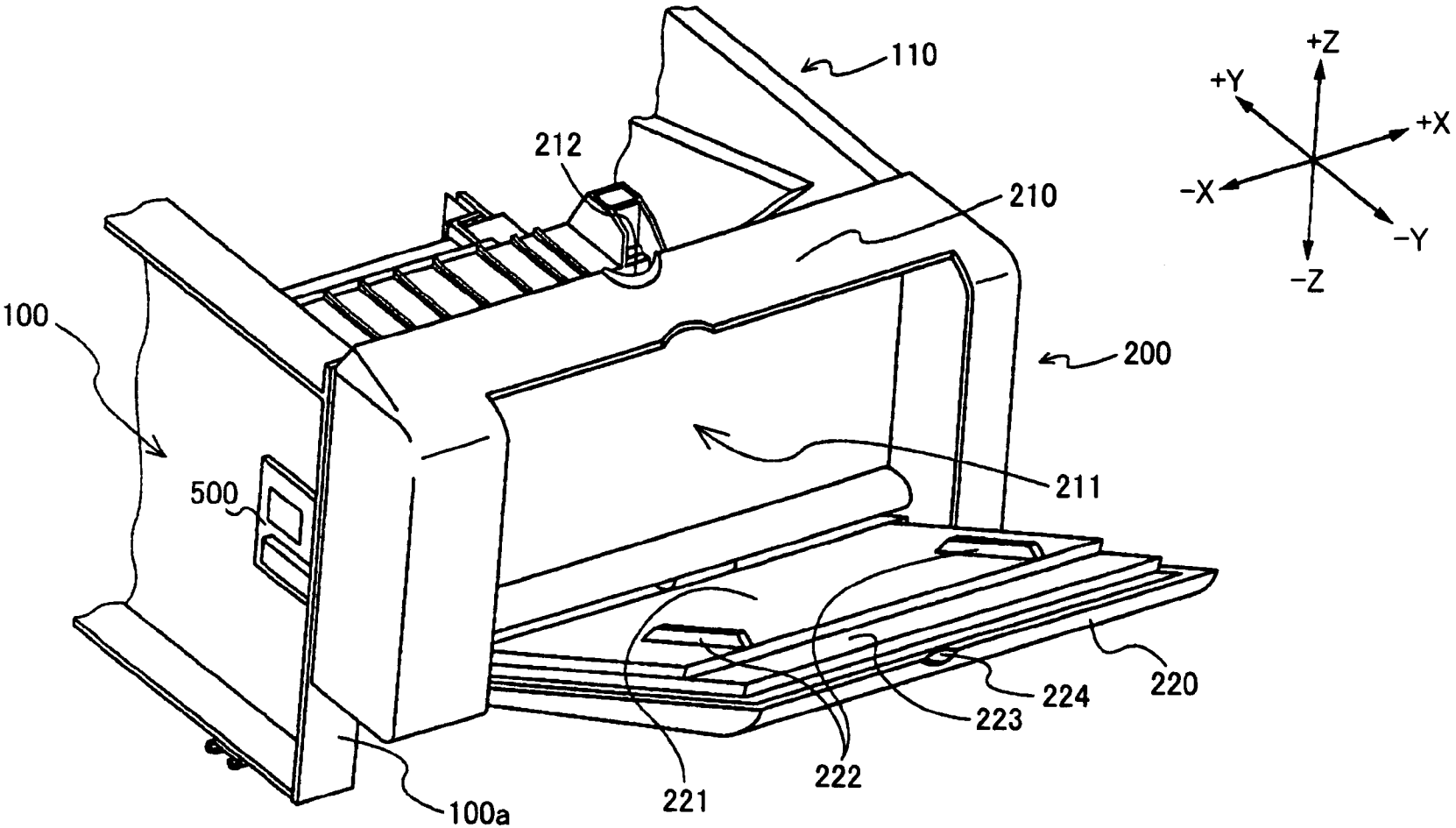
FIG. 7 is a perspective view showing the multipurpose unit in an open state.

Next, the multipurpose tray 220 will be described. The multipurpose tray 220 is for holding a stack of paper and guiding a single sheet of the stack of paper into the A section (FIG. 1). As shown in FIG. 7, a first holding unit 221, a paper guide 222, and a second holding unit 223 are provided on the inside surface of the multipurpose tray 220. A stack of paper 3 is loaded onto the first holding unit 221. The paper guide 222 aligns the stack of paper 3 loaded in the first holding unit 221 by pressing on the left and right sides of the same. The second holding unit 223 can be pulled out toward the user while remaining connected to the first holding unit 221 to expand the paper loading surface area. The user can grip a recess part 224 formed at the top of the multipurpose tray 220 with a finger to open the multipurpose tray 220 and can load a plurality of sheets of paper onto the first holding unit 221 and the second holding unit 223 when the multipurpose tray 220 is in an open state U-shaped bearings (not shown) are provided on the left and right bottom edges of the multipurpose tray 220. These bearings engage with the support shafts 440*j* of the chute 440 shown in FIG. 4. With this construction, the multipurpose tray 220 can be opened with the front side facing downward as shown in FIG. 7.

In this way, the multipurpose tray 220 can be opened and closed about the shafts 440*j*. Although the multipurpose tray 220 swings about shafts provided to the bottom of the cover body 210, the actual shafts 440*j* of the multipurpose tray 220 are independent from the cover body 210, since the shafts 440*j* are provided to the supplying/mounting mechanism 600.

The multipurpose unit 200 with this construction can be mounted on the laser printer 1 by mounting the left and right mounting frames 410 and 420 on the side walls 110*a* and 110*b* of the left and right frames 100 and 110 according to the aforementioned procedure.

The manual feed unit 300 will be described in greater detail. As described above, the manual feed unit 300 includes the cover body 310 and the manual feed tray 320 shown in FIG. 9.

Figure 10:
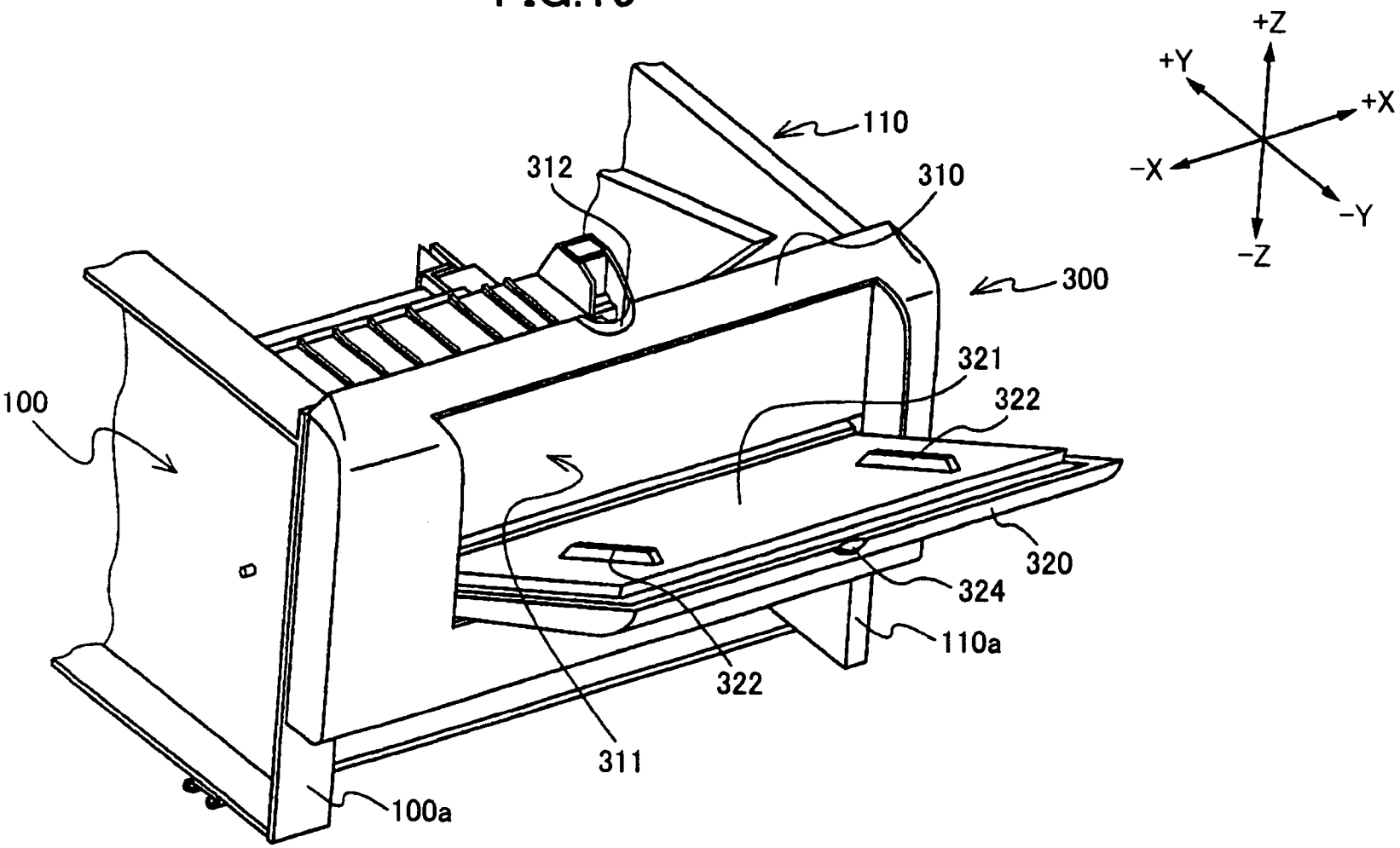
FIG. 10 is a perspective view showing a manual feed tray of the manual feed unit in an open state.

As shown in FIG. 10, a holding unit 321 and a paper guide 322 are provided on the inside surface of the manual feed tray 320. A single sheet of paper 3 is loaded onto the holding unit 321. The paper guide 322 guides the single sheet of paper 3 loaded on the holding unit 321 in the supply direction by pressing on the left and right sides thereof. The manual feed tray 320 can be opened downward on the front of the laser printer 1 by rotating about the shafts provided to the side edges of the manual feed tray 320 at the lower position. Bearings for supporting the shafts of the manual feed tray 320 are provided on the cover body 310. Accordingly, the positional relationship of the bearings and the main casing 2 changes along with the opening and closing of the cover body 310. The user opens the manual feed tray 320 by gripping a recessed part 324 formed in the top of the manual feed tray 320 with a finger, enabling the user to set a single sheet of paper on the holding unit 321.

The manual feed unit 300 with this construction is mounted on the laser printer 1 by fitting shafts of the cover body 310 into the bearing protrusions 105 and 115 provided on the left and right frames 100 and 110 (FIG. 4). As shown in FIG. 11, the cover body 310 can be swung open widely by moving the top edge of the cover body 310 forward and downward about the shafts fitted into the bearing protrusions 105 and 115, while the manual feed tray 320 is accommodated in the tray accommodating section 311.

As described above, the shafts of the manual feed tray 320 are supported by the cover body 310. Hence, the manual feed unit 300 can be mounted on the left and right frames 100 and 110 while the manual feed tray 320 is mounted on the cover body 310, thereby simplifying the mounting operation.

As shown in FIG. 11, when mounting the manual feed unit 300 on the laser printer 1, a shielding plate 480 formed of a metal plate can be mounted over the side wall 100*a* of the left frame 100 in order to preserve the beauty of the laser printer 1 by covering the gear hole 103 and the like to prevent components inside the left frame 100 from being exposed via the gear hole 103 and the like. Holes corresponding to the screw holes 101, 104, the hooking pawl 102, and the like used for fixing the left mounting frame 410 are formed in the shielding plate 480 at positions corresponding to these holes 101, 104 and the like, so that the same holes 101, 104 and the like can be used to fix the shielding plate 480. The procedure for mounting the shielding plate 480 is identical to that for mounting the left mounting frame 410. That is, the position of the shielding plate 480 is determined by the hooking pawl 102, and the shielding plate 480 is fixed to the side wall 100*a* by inserting screws into the screw holes 101 and 104.

As described above, when the multipurpose unit 200 is fixed to the left frame 100 and the right frame 110, as shown in FIG. 8, part of the gear 470 is exposed to the interior of the left frame 100 via the gear hole 103. This exposed part of the gear 470 engages with a gear 100*d* (FIG. 5) of the drive system not shown and transfers the driving force from the DC motor (not shown). Since the paper supply roller 450 needs only be driven when supplying paper, a trigger unit 500 is disposed inside the left frame 100 for switching the paper supply roller 450 between drive and idle states.

Figure 5:
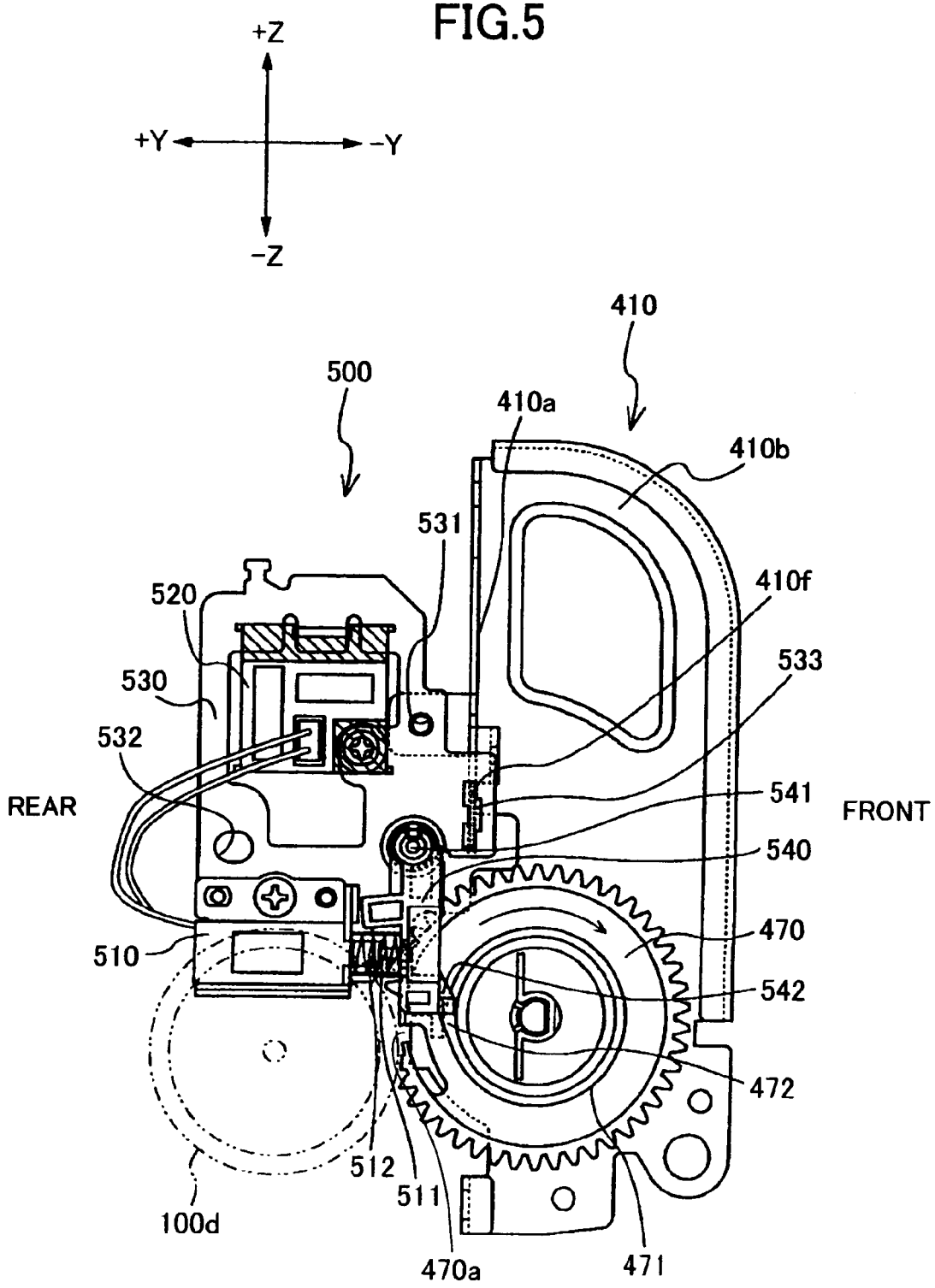
FIG. 5 is a side view of a trigger unit and a gear of the laser printer.

As shown in FIG. 5, the trigger unit 500 includes a solenoid 510, a relay circuit board 520, a substantially rectangular fixing plate 530, and a pole-shaped trigger 540. The solenoid 510 is fixed to the bottom end of the fixing plate 530 so that the operating direction of an operating core 511 in the solenoid 510 follows the shorter dimension of the fixing plate 530 (Y direction).

The leading end of the operating core 511 is positioned approximately at the bottom front corner of the fixing plate 530. The top end of the trigger 540 is supported at a support point 541 and can swing along the surface of the fixing plate 530. The support point 541 is disposed above the leading edge of the operating core 511 and near the lengthwise center of the fixing plate 530. The bottom end of the trigger 540 is supported on the leading edge of the operating core 511. A spring 512 is wrapped around the operating core 511 for pressing the free end of the trigger 540 forward.

The relay circuit board 520 is fixed to a position rearward from the center of the fixing plate 530. The solenoid 510 is connected to the relay circuit board 520 and operates based on a drive current applied from the engine circuit board 85 (FIG. 1) via the relay circuit board 520. That is, when a drive current is applied to the solenoid 510, the operating core 511 is drawn into the body of the solenoid 510, causing the free end of the trigger 540 to move toward the solenoid 510. When the drive current applied to the solenoid 510 is halted, the spring 512 moves the free end of the trigger 540 in a direction away from the solenoid 510. In this way, the trigger 540 is operated in association with the solenoid 510.

Screw holes 531 and 532 are formed in the fixing plate 530. The trigger unit 500 is detachably fixed to the left frame 100 as shown in FIG. 6 via screws engaged with the screw holes 531 and 532 and the two screw receivers 10*c* provided in the left frame 100.

The trigger unit 500 having this construction regulates the rotation of the gear 470. Since the position of the trigger unit 500 must be set in relation to the left mounting frame 410 when the multipurpose unit 200 is mounted, a positioning hole 533 is formed in the trigger unit 500 near the support point 541 for fitting over the protrusion 410*f* (FIG. 4) of the left mounting frame 410.

As shown in FIG. 5, a protruding pawl 542 is provided on the leading edge of the free end of the trigger 540. An inner periphery 471 is provided on the gear 470 a step inside the outer periphery in which the gear teeth are provided. A protrusion 472 is formed on the inner periphery 471 (see FIG. 13). The pawl 542 of the trigger 540 slides along the inner periphery 471 of the gear 470 as the gear 470 rotates. When the protrusion 472 contacts the pawl 542, rotation of the gear 470 halts at that position. At this point, the toothless portion 470*a* of the gear 470 is positioned opposite the gear 110*d*, enabling the gear 100*d* to spin idly since the teeth of the gear 100*d* are not engaged with the teeth of the gear 470. By regulating rotations of the gear 470 in an idle state of the solenoid 510 in this way, the driving force of the DC motor is not transferred to the gear 470 and, hence, is not transferred to the paper supply roller 450.

A protrusion (not shown) is provided on the surface of the gear 470 opposite the surface in which the inner periphery 471 is provided. The protrusion is urged away from the left mounting frame 410 by a spring or the like (not shown) when the gear 470 is in its halted position. Hence, the gear 470 is urged in the direction of rotation when its rotations are halted.

Figure 13:
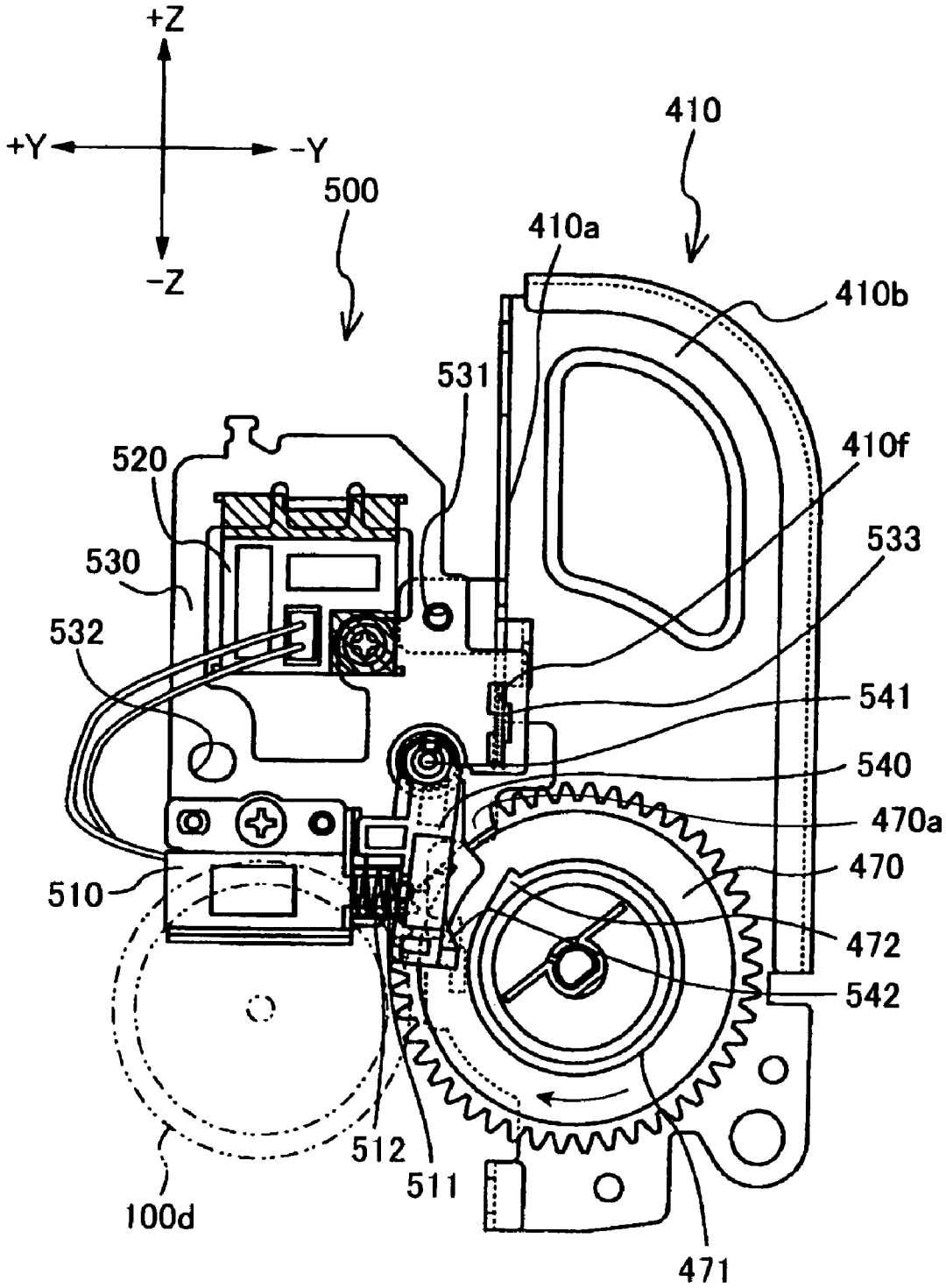
FIG. 13 is a side view showing the trigger unit and the gear.

However, when the solenoid 510 is driven, the operating core 511 is drawn into the body of the solenoid 510, causing the free end of the trigger 540 to move in the +Y direction. As a result, the pawl 542 is disengaged from the protrusion 472, and the gear 470 is rotated clockwise by the spring as shown in FIG. 13. Since the toothless portion 470*a* also moves with the rotation of the gear 470, the teeth of the gear 470 engage with the gear 110*d*. Accordingly, the driving force of the drive system is transferred to the gear 470, which drives the paper supply roller 450 to separate and paper 3.

As described above, according to the present embodiment, the regulating member 444 supporting the separating pad 442 is formed of a metal plate and is fixed to the bottom plate 440*b* of the chute 440. Accordingly, the regulating member 444 can reinforce the bottom plate 440*b*, which supports the supporting member 443, and can increase the rigidity of the chute 440 sufficiently, despite the chute 440 being not very thick. Further, since the supporting member 443 is formed of a metal plate, the supporting member 443 can be made smaller than one formed from a synthetic resin, making it possible to manufacture a more compact supply unit. Forming the regulating member 444 with a metal plate also contributes to manufacturing a more compact supply unit. Since the regulating member 444 regulates the range in which the supporting member 443 can swing, it is possible to replace a worn paper supply roller 450 without holding down the supporting member 443, thereby improving operating efficiency. Further, the chute 440 is configured from the bottom plate 440*b* and the side plate 440*c* so as to be less strong near the recess 440*g* than at other positions of the chute 440. However, the size of the recess 440*g* can be decreased by manufacturing more compact supporting member 443 and regulating member 444, thereby decreasing the size of the weaker portions. Moreover, because the chute 440 is formed of a resin combined of a reinforcing material, such as glass fibers, sufficient strength is achieved for withstanding bending, skewing, and the like.

The trigger unit 500 for toggling the drive and idle states of the paper supply roller 450 and the paper pressing plate 460 is mounted in the left frame 100, rather than in the multipurpose unit 200. Accordingly, the multipurpose unit 200 can be made more compact in order to decrease the overall size of the laser printer 1.

Since the construction for mounting the left mounting frame 410 and the right mounting frame 420, that is, the screw holes 101, 104, 111, 114, the hooking pawls 102, 112, and the gear hole 103, is disposed on the side walls 100*a* and 110*a* on the front surfaces of the left and right frames 100 and 110, operations for fixing the left mounting frame 410 and the right mounting frame 420 can be performed on the front surface of the left frame 100 and the right frame 110, thereby facilitating mounting of the multipurpose unit 200.

The open/close shafts of the multipurpose tray 220 are independent from the cover body 210. Therefore, load caused by the weight of paper stacked in the multipurpose tray 220 and the load caused by the weight of the cover body 210 can be distributed at separate supporting points, thereby improving the durability of each supporting point.

By providing a common construction for mounting the multipurpose unit 200 and the manual feed unit 300 on the left and right frames 100 and 110, it is not necessary to produce different frames for each model of the laser printer 1, thereby reducing production costs.

Since differing units 200 and 300 can be selectively mounted in the same laser printer 1 to suit design specifications, a plurality of models may be supplied for various applications while maintaining the same common construction of the laser printer 1. Further, since the multipurpose unit 200 and the manual feed unit 300 are provided with the cover body 210 and the cover body 310 to enable insertion and removal of the processing cartridge 17, there is no need to provide a separate cover for removing the laser printer 1, enabling the overall size of the laser printer 1 to be reduced.

Since the gear 470 engages with the gear 100*d* via the gear hole 103 provided in the left frame 100, it is not necessary to run the path for transferring driving force to the side surface of the left frame 100. Accordingly, the number of parts used to configure the drive system can be reduced, thereby reducing manufacturing costs.

Since the supply mechanism, which includes the paper supply roller 450 for separating a single sheet of the stacked recording medium and supplying the sheets to the processing cartridge 17, can be mounted in the multipurpose unit 200 but omitted from the manual feed unit 300, the present invention can provide a plurality of models of the laser printer 1 for various applications.

While some exemplary embodiments of this invention have been described in detail, those skilled in the art will recognize that there are many possible modifications and variations which may be made in these exemplary embodiments while yet retaining many of the novel features and advantages of the invention.

For example, while the left and right mounting frames 410 and 420 are fixed to the side walls 110*a* and 110*a* by screws, the left and right mounting frames 410 and 420 can be fixed by hooks or the like as well. Further, the shielding plate 480 may be formed of a synthetic resin material. Moreover, the regulating member 444 can be formed longer in the left-to-right direction of the chute 440 or can be configured as a member bridging the left mounting frame 410 and the right mounting frame 420. The chute 440 may also be made more compact, even though the rigidity of the chute 440 will decrease, by providing means to reinforce the chute 440.

What is claimed is:

1. An image forming device comprising:

an image forming unit that forms an image on a recording medium; and a frame that detachably supports the image forming unit and that selectively supports a manual feed unit having a guide unit that supports and guides a single sheet of recording medium to the image forming unit and a multipurpose unit having a supply unit that supports a stack of recording medium and supplies a single sheet of the stack of recording medium to the image forming unit, the frame including a first mounting unit and a second mounting unit, the frame being formed with an opening through which the image forming unit is mounted to and detached from the frame, wherein the first mounting unit is capable of swingably mounting the manual feed unit that includes a cover that covers the opening of the frame and a guide unit that supports and guides a single sheet of recording medium to the image forming unit; and the second mounting unit is capable of mounting the multipurpose unit that includes a cover that covers the opening of the frame and a supply unit that supports a stack of recording medium and supplies a single sheet of the stack of recording medium to the image forming unit.

2. The image forming device according to claim 1, further comprising:

a fixing member provided to the frame, the fixing member being capable of mounting a trigger unit that switches between an operating state and an idle state of the supply unit when the multipurpose unit is attached to the second mounting unit.

3. The image forming device according to claim 2, wherein the first mounting unit swingably supports the manual feed unit.

4. The image forming device according to claim 2, wherein the second mounting unit supports a mounting frame of the multipurpose unit that supports the supply unit of the multipurpose unit.

5. The image forming device according to claim 2, wherein the image forming unit is detachably mounted on the frame, the image forming unit being detachable from the frame when pulled in a detaching direction, and the second mounting unit is provided to the frame at a side facing the detaching direction.

6. The image forming device according to claim 2, wherein the frame is formed with an exposure hole for exposing a gear of the multipurpose unit that transmits a drive force to the supply unit.

7. The image forming device according to claim 6, wherein the frame is provided with a shielding-member-fixing unit at a position near the exposure hole, the shielding-member-fixing unit being for fixing a shielding member to cover the exposure hole.

8. The image forming device according to claim 2, further comprising a main casing and the manual feed unit, the main casing being provided with an engaging member, wherein the manual feed unit includes:

a cover swingably supported on the first mounting unit, the cover being swingable between an open state and a closed state, wherein the image forming unit is detachable from the frame when the cover is in the open state;

the guide unit including a manual feed tray supported on the cover so as to be swingable between an open state and a closed state, the manual feed tray in the open state supporting the single sheet of recording medium;

a hook disposed on a free end of the cover, the hook being engageable with the engaging member to maintain the cover in the closed state; and a release button that disengages the hook from the engaging member.

9. The image forming device according to claim 2, further comprising the multipurpose unit, the multipurpose unit including:

a mounting frame supported on the second mounting unit of the frame;

a cover swingably supported on the mounting frame, the cover being swingable between an open state and a closed state, wherein the image forming unit is detachable from the frame when the cover is in the open state; and the supply unit that includes a multipurpose tray swingably supported on the mounting frame, the multipurpose tray being swingable independent from the cover between an open state and a closed state, the multipurpose tray in the open state supporting the stack of recording medium.

10. The image forming device according to claim 9, wherein the supply unit further includes a feed unit supported by the mounting frame, the feed unit including a feed member that feeds the single sheet of the stack of recording medium on the multipurpose tray to the image forming unit and a separating member that separates the single sheet of recording medium from the stack of recording medium in cooperation with the feed member.

11. The image forming device according to claim 10, wherein the supply unit of the multipurpose unit further includes:

a first support member that supports the separating member;

a second support member that swingably supports the first support member;

an urging member that urges the first support member to press the separating member onto the feed member; and a regulating member formed of a metal plate with a first surface and a second surface, the first surface of the regulating member being fixed to the second support member, the regulating member regulating a swingable range of the first support member by abutting the first support member with the second surface.

12. The image forming device according to claim 11, wherein the first support member is made of a molded metal plate.

13. The image forming device according to claim 11, wherein the second support member is formed of a resin including a reinforcing material.

14. The image forming device according to claim 1, wherein the second mounting unit supports a mounting frame of the multipurpose unit that supports the supply unit of the multipurpose unit.

15. The image forming device according to claim 1, wherein the image forming unit is detachable from the frame when pulled in a detaching direction, and the second mounting unit is provided to the frame at a side facing the detaching direction.

16. The image forming device according to claim 1, wherein the frame is formed with an exposure hole for exposing a gear of the multipurpose unit that transmits a drive force to the supply unit.

17. The image forming device according to claim 16, wherein the frame is provided with a shielding-member-fixing unit at a position near the exposure hole, the shielding-member-fixing unit being for fixing a shielding member to cover the exposure hole.

18. The image forming device according to claim 1, further comprising a main casing and the manual feed unit, the main casing being provided with an engaging member, wherein the manual feed unit includes:

the cover swingably supported on the first mounting unit, the cover being swingable between an open state and a closed state, wherein the image forming unit is detachable from the frame when the cover is in the open state;

the guide unit including a manual feed tray supported on the cover so as to be swingable between an open state and a closed state, the manual feed tray in the open state supporting the single sheet of recording medium;

a hook disposed on a free end of the cover, the hook being engageable with the engaging member to maintain the cover in the closed state; and a release button that disengages the hook from the engaging member.

19. The image forming device according to claim 1, further comprising the multipurpose unit, the multipurpose unit including:

a mounting frame supported on the second mounting unit of the frame;

the cover swingably supported on the mounting frame, the cover being swingable between an open state and a closed state, wherein the image forming unit is detachable from the frame when the cover is in the open state; and the supply unit that includes a multipurpose tray swingably supported on the mounting frame, the multipurpose tray being swingable independent from the cover between an open state and a closed state, the multipurpose tray in the open state supporting the stack of recording medium.

20. The image forming device according to claim 19, wherein the supply unit further includes a feed unit supported by the mounting frame, the feed unit including a feed member that feeds the single sheet of the stack of recording medium on the multipurpose tray to the image forming unit and a separating member that separates the single sheet of recording medium from the stack of the recording medium in cooperation with the feed member.

21. The image forming device according to claim 20, wherein the supply unit of the multipurpose unit further includes:

a first support member that supports the separating member;

a second support member that swingably supports the first support member;

an urging member that urges the first support member to press the separating member onto the feed member; and a regulating member formed of a metal plate with a first surface and a second surface, the first surface of the regulating member being fixed to the second support member, the regulating member regulating a swingable range of the first support member by abutting the first support member with the second surface.

22. The image forming device according to claim 21, wherein the first support member is made of a molded metal plate.

23. The image forming device according to claim 21, wherein the second support member is formed of a resin including a reinforcing material.

* * * * *